US006939225B2

(12) United States Patent
Kaminkow

(10) Patent No.: US 6,939,225 B2
(45) Date of Patent: Sep. 6, 2005

(54) GAMING DEVICE HAVING BONUS GAME WITH MULTIPLE MOVING OBJECTS WITHIN PARTITIONABLE CHANNELS

(75) Inventor: Joseph E. Kaminkow, Reno, NV (US)

(73) Assignee: IGT, Reno, NV (US)

( * ) Notice: Subject to any disclaimer, the term of this patent is extended or adjusted under 35 U.S.C. 154(b) by 411 days.

(21) Appl. No.: 10/186,369

(22) Filed: Jun. 27, 2002

(65) Prior Publication Data

US 2004/0002373 A1 Jan. 1, 2004

(51) Int. Cl.[7] ..... A63F 9/22
(52) U.S. Cl. ..... 463/16
(58) Field of Search ..... 463/16, 20

(56) References Cited

U.S. PATENT DOCUMENTS

| | | | | |
|---|---|---|---|---|
| 2,545,644 A | | 3/1951 | Benton et al. | |
| 4,410,178 A | | 10/1983 | Partridge | |
| 4,508,346 A | | 4/1985 | Salvucci | |
| 4,871,171 A | | 10/1989 | Rivero | |
| 5,014,988 A | | 5/1991 | Mirando et al. | |
| 5,067,712 A | * | 11/1991 | Georgilas | 463/21 |
| 5,362,052 A | | 11/1994 | Kubatsch | |
| 5,380,007 A | | 1/1995 | Travis et al. | |
| 5,501,455 A | | 3/1996 | Hirata et al. | |
| 5,566,940 A | | 10/1996 | Powell | |
| 5,584,763 A | | 12/1996 | Kelly et al. | |
| 5,639,089 A | | 6/1997 | Matsumoto et al. | |
| 5,743,526 A | | 4/1998 | Inoue | |
| 5,755,619 A | | 5/1998 | Matsumoto et al. | |
| 5,766,076 A | * | 6/1998 | Pease et al. | 463/27 |
| 5,785,594 A | * | 7/1998 | Seibert et al. | 463/17 |
| 5,788,230 A | | 8/1998 | Krise et al. | |
| 5,823,874 A | | 10/1998 | Adams | |
| 5,848,932 A | | 12/1998 | Adams | |
| 5,882,261 A | | 3/1999 | Adams | |
| 5,911,418 A | | 6/1999 | Adams | |
| 5,964,463 A | | 10/1999 | Moore, Jr. | |
| 6,047,963 A | | 4/2000 | Pierce et al. | |
| 6,059,658 A | | 5/2000 | Mangano et al. | |
| 6,071,192 A | | 6/2000 | Weiss | |
| 6,082,734 A | | 7/2000 | Uehara et al. | |
| 6,089,978 A | | 7/2000 | Adams | |
| 6,105,962 A | | 8/2000 | Malavazos et al. | |
| 6,110,039 A | | 8/2000 | Oh | |
| 6,120,377 A | | 9/2000 | McGinnis, Sr. et al. | |
| 6,139,013 A | | 10/2000 | Pierce et al. | |
| 6,142,873 A | | 11/2000 | Weiss et al. | |

(Continued)

OTHER PUBLICATIONS

Fey, Slot Machines, A Pictorial History of the First 100 Years, Liberty Belle Books, 1983, pp 188, 202.*

Post, Slot Machines of Yesteryear, Mills of the Thirties, Post ERA Books, 1979, pp 89, 112–114 & 155.*

(Continued)

*Primary Examiner*—Xuan M. Thai
*Assistant Examiner*—Corbett Cobum
(74) *Attorney, Agent, or Firm*—Bell, Boyd & Lloyd LLC

(57) ABSTRACT

A gaming device including plurality of aligned channels mounted to the cabinet and a movable object is positioned in each channel. An actuator for engaging the movable object is positioned at the base of each channel and a partitioner for partitioning each channel into a plurality of sections is connected to each channel. An award is provided to the player based on the sections the moveable objects are captured in after the partitioners partition the channels into a plurality of sections.

71 Claims, 16 Drawing Sheets

U.S. PATENT DOCUMENTS

| | | | | |
|---|---|---|---|---|
| 6,162,121 | A | | 12/2000 | Morro et al. |
| 6,173,955 | B1 | | 1/2001 | Perrie et al. |
| 6,203,008 | B1 | | 3/2001 | Krise et al. |
| 6,203,009 | B1 | | 3/2001 | Sines et al. |
| 6,213,876 | B1 | | 4/2001 | Moore, Jr. |
| 6,220,593 | B1 | | 4/2001 | Pierce et al. |
| 6,224,483 | B1 | | 5/2001 | Mayeroff |
| 6,305,686 | B1 | | 10/2001 | Perrie et al. |
| 6,322,071 | B1 | | 11/2001 | Chaaban |
| 6,336,863 | B1 | | 1/2002 | Baerlocher et al. |
| 6,338,678 | B1 | | 1/2002 | Seelig et al. |
| 6,340,158 | B2 | | 1/2002 | Pierce et al. |
| 6,390,470 | B1 | | 5/2002 | Huang |
| 6,398,217 | B1 | | 6/2002 | Shimizu et al. |
| 6,398,219 | B1 | | 6/2002 | Pierce et al. |
| 6,416,053 | B1 | | 7/2002 | Kamimura |
| 6,419,225 | B2 | | 7/2002 | Sines et al. |
| 6,419,226 | B2 | | 7/2002 | Krise et al. |
| 6,450,884 | B1 | | 9/2002 | Seelig et al. |
| 6,481,713 | B2 | | 11/2002 | Perrie et al. |
| 6,533,660 | B2 | | 3/2003 | Seelig et al. |
| 6,582,307 | B2 | | 6/2003 | Webb |
| 6,638,165 | B2 | * | 10/2003 | Uchiyama et al. ..... 463/20 |
| 6,656,043 | B2 | | 12/2003 | Seelig et al. |
| 6,764,396 | B2 | | 7/2004 | Seelig et al. |
| 2002/0082072 | A1 | | 6/2002 | Seelig et al. |
| 2002/0151343 | A1 | | 10/2002 | Seelig et al. |
| 2003/0027620 | A1 | | 2/2003 | Seeling et al. |
| 2003/0060265 | A1 | | 3/2003 | Webb |
| 2003/0069061 | A1 | | 4/2003 | Seelig et al. |
| 2004/0082377 | A1 | | 4/2004 | Seelig et al. |
| 2004/0147305 | A1 | | 7/2004 | Seelig et al. |

OTHER PUBLICATIONS

IDU Dice Unit Advertisement written by starpoint.uk.com, printed on May 14, 2001.
IDU Dice Mechanism written by Starpoint Electrics Ltd, published Jul. 2000.
4DU Dice Unit Advertisement written by starpoint.uk.com, printed on Sep. 3, 2002.
Double Dice Advertisement written by JHV Gaming Products, undated and English explanation from errel.com, printed on Jan. 24, 2003.
Empire Advertisement, written by AC Coin Slot, published 1996.
Free! 7–Day Trial on Daval's Reel Dice Advertisement written by Gerber & Glass, published 1936.
Game Devices Advertisement written by starpoint.uk.com, printed on Sep. 3, 2002.
Gold Rush Advertisement, written by AC Coin & Slot, published Sep. 2002.
Instant Slotto Article, written by Strictly Slots, published Apr. 2001.
Jack and the Beanstalk Article, written by Strictly Slots, published Jul. 2002.
King of the Grill Advertisement, written by AC Coin & Slot, published Sep. 2002.
Levy Patent Abstract written by Derwent Publications Ltd., published 1991.
Little Green Men, Jr. Advertisement, written by AC Coin & Slot, published prior to 2002.
Little Green Men, Jr. Article, written by Strictly Slots, published Feb. 2002.
Little Green Men, Jr. Article, written by Strictly Slots, published Jan. 2003.
Party Time Razzle Dazzle Advertisement, written by IGT, published 1999.
Power Slotto Advertisement, written by AC Coin & Slot.
Press Your Luck Advertisement, written by AC Coin & slot.
Razzle Dazzle Advertisement, written by Barcrest Games, available prior to 2002.
Slot Machines A Pictorial History of the First 100 years, 5$^{th}$ Edition, written by Marshall Fey.
Slot Machine Buyer's Handbook A Consumer's Guide to Slot Machines written by David L. Saul and Daniel R. Mead, published 1998.
Slot Machines On Parade written by Robert N. Geddes and illustrated by Daniel R. Mead, published 1980.
Slot Spot light; written by AC Coin & Slot 2003.
Starpoint 1 DU Dice Unit Product Summary writer by Starpoint Electrics, Ltd., published Dec. 1999.
Starpoint 4DU Game Device Product Summary written by Starpoint Electrics, Ltd., published prior to 2002.

* cited by examiner

GAMING DEVICE HAVING BONUS GAME WITH MULTIPLE MOVING OBJECTS WITHIN PARTITIONABLE CHANNELS

CROSS-REFERENCE TO RELATED APPLICATIONS

This application relates to the following co-pending commonly owned patent applications: "GAMING DEVICE HAVING AN INTERACTIVE MATRIX GAME," Ser. No. 10/160,601, "GAMING DEVICE HAVING AN INCREMENTING AWARD GAME," Ser. No. 10/185,415, "GAMING DEVICE HAVING A DIE OR DICE DIRECTLY ASSOCIATED WITH THE REELS IN THE PRIMARY GAME," Ser. No. 10/355,466, "GAMING DEVICE HAVING A MECHANICAL AWARD INDICATOR," Ser. No. 10/256,618, and "GAMING DEVICE HAVING A MECHANICAL AWARD INDICATOR," Ser. No. 10/256,937.

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

DESCRIPTION

The present invention relates in general to a gaming device, and more particularly to a gaming device having a multiple moving object game.

BACKGROUND OF THE INVENTION

Gaming devices such as slot machines, video poker machines, blackjack machines and keno machines are well-known. Such gaming devices generally require that the player make a bet or wager to initiate each game, play a game cycle of the game using an arm, play button, bet one button, max bet button, repeat bet button, or other suitable indicator which accepts the player's decision to make a wager and initiate play of the game.

Additionally, many gaming device incorporate bonus or secondary games which enable a player to receive an award in addition to any award achieved during the play of the primary game. One well known bonus game involves a lottery type game which includes a machine for mixing a plurality of balls. Each ball has an award amount associated with it. The gaming device selects one of the mixed balls and the player obtains the award amount based on or associated with the selected ball.

Since players continue to seek more entertainment and enjoyment from different types of gaming devices, it is desirable to provide players with gaming devices having new features that increase player use and enjoyment, such as one or more payout indicators for providing players with additional awards.

SUMMARY OF THE INVENTION

The present invention provides a gaming device having a multiple moving object game and in particular a bonus game. In one preferred embodiment, the objects are multiple moving balls, however it should be appreciated that other suitable objects may be employed in accordance with the present invention. Each movable object has a usable symbol, such as an award amount, a multiplier (or other modifier) associated with it. One embodiment of the present invention includes a plurality of vertically aligned directors, such as tubular members or cylindrical tubes mounted to the cabinet of the gaming device. A movable object or ball is positioned in and rests at the base of each tube. An actuator for engaging the movable object or ball is positioned at the base of each tube. A partitioner for partitioning each tube into a plurality of sections is attached or connected to each tube. A plurality of sensors which are adapted to determine the location of each movable object or ball are also attached or connected to each tube at varying positions or heights along the tube. The actuator, partitioner and plurality of sensors are connected to or in communication with the gaming device processor.

In one embodiment of the present invention, upon the triggering of the bonus game, the gaming device activates the actuators positioned at the base of each vertically aligned tube. The activated actuator engages the bottom of the movable object positioned at the base of each director or tube, thereby propelling the movable object into the upper portion of the tube. Each activated actuator remains activated to continuously engage each movable object. Each time a movable object returns to the base of it's tube, it is repropelled into the upper portion of the tube. It should be appreciated that the actuators can be simultaneously activated, sequentially activated, or randomly activated by the processor or the actuators can be activated by the player. The partitioner in each tube is adapted to extend into the tube to partition each tube into an upper and a lower section. When activated, the partitioners capture or prevent the moving objects located in the upper section of each tube from moving down to the base. It should be appreciated that the partitioners can be simultaneously activated, sequentially activated, or randomly activated by the processor or the partitioners can be activated by the player. Sensors positioned along the inner wall of each tube, such as slightly above the base, sense the location and direction of movement of each movable object. If the sensors determine that a movable object is captured or stopped in a specific partitioned section of a tube, such as the upper section, then the player obtains the award associated with the symbol indicated on the captured movable object.

In an alternative embodiment of the present invention, the plurality of directors or tubes are mounted in a horizontal position on the cabinet of the gaming device. In this embodiment an actuator is mounted at each end of the tube to actuate the movable object. When activated by the gaming device, the actuators propel the movable objects back and forth throughout the tubes. As described above, each tube includes a partitioner to capture the movable object and sensors positioned along the inner wall of each tube to sense the location of each movable object. If the sensors determine that a movable object is captured or stopped in a specific partitioned section of a tube, the player obtains the award associated with the symbol indicated on the captured movable object. It should also be appreciated that the award can be determined based on which section the object is captured in.

It is therefore an advantage of the present invention to provide a multiple movable object gaming device.

Other objects, features and advantages of the invention will be apparent from the following detailed disclosure, taken in conjunction with the accompanying sheets of drawings, wherein like numerals refer to like parts, elements, components, steps and processes.

DETAILED DESCRIPTION OF THE INVENTION

Figure 1A:
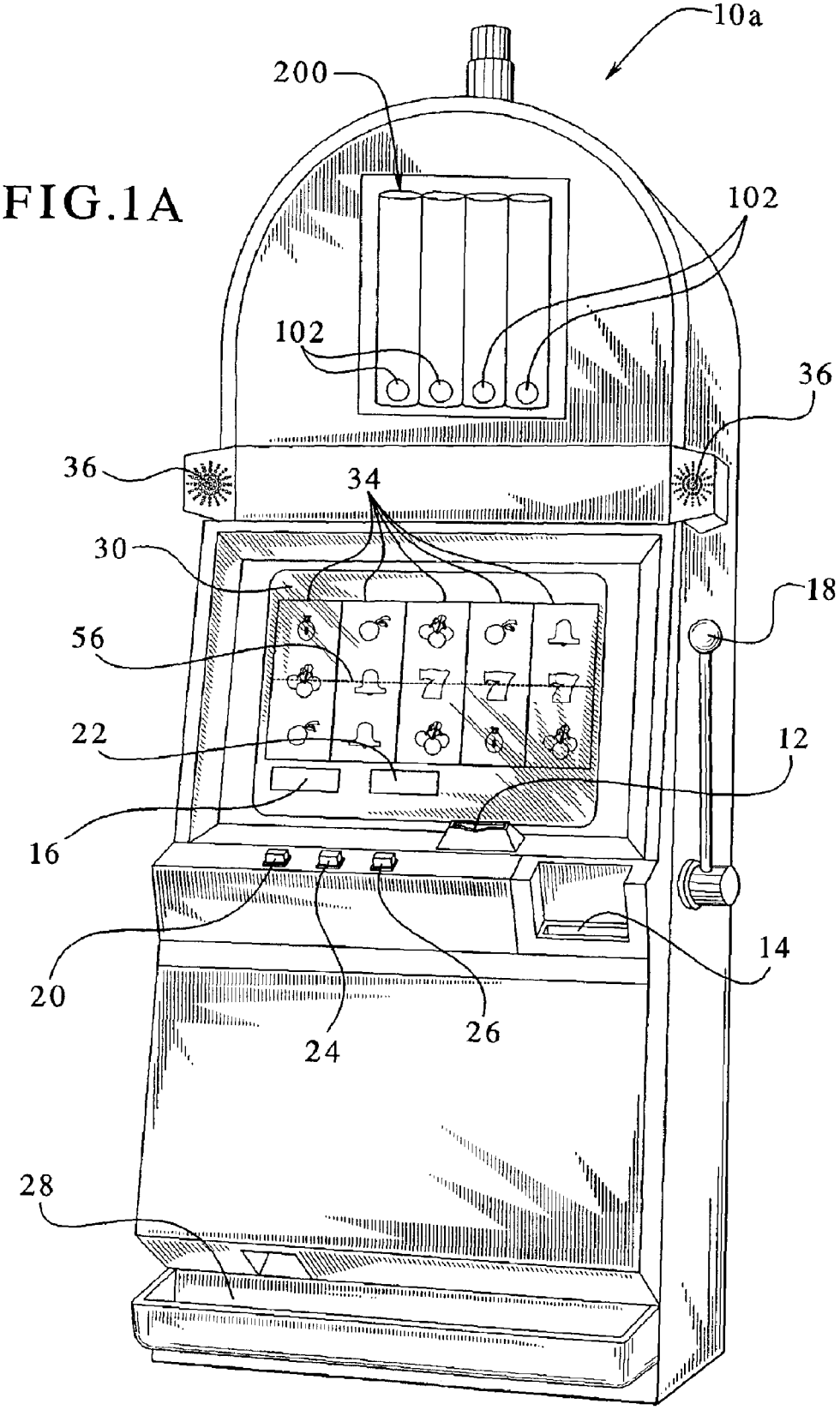
FIGS. 1A, 1B and 1C are perspective views of alternative embodiments of the gaming device of the present invention.
Figure 1B:
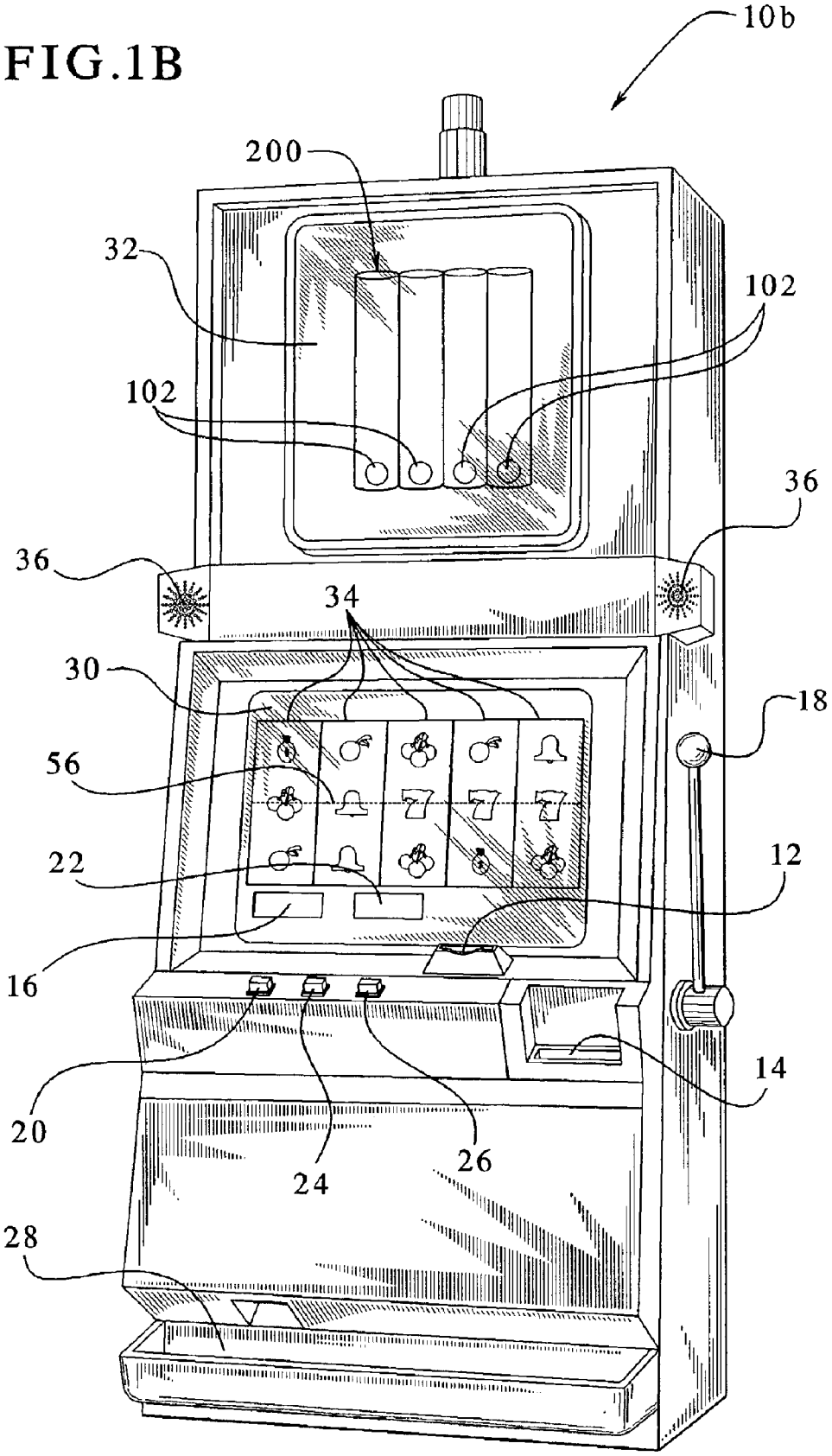
Figure 1C:
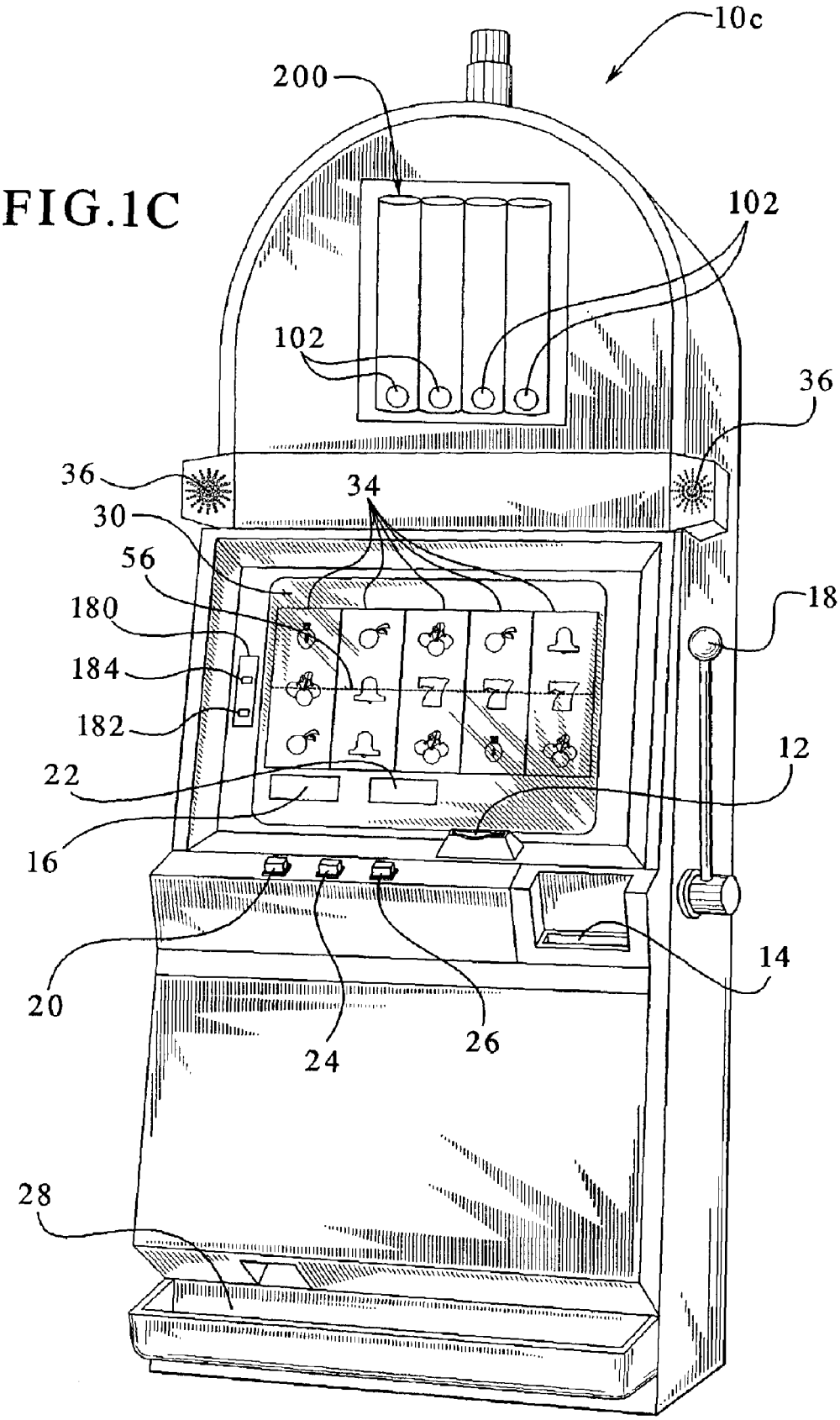

Referring now to the drawings, three embodiments of the gaming device of the present invention are illustrated in FIGS. 1A, 1B and 1C as gaming device 10*a*, gaming device 10*b* and gaming device 10*c*, respectively. In one embodiment, the gaming device is a slot machine having the controls, displays and features of a conventional slot machine. It is constructed so that a player can operate it while standing or sitting, and gaming device is preferably mounted on a console. However, it should be appreciated that gaming device can be constructed as a pub-style table-top game (not shown) which a player can operate preferably while sitting. Furthermore, gaming device can be constructed with varying cabinet and display designs, as illustrated by the designs shown in FIGS. 1A through 1C.

The gaming device of the present invention could alternatively incorporate any other primary game such as poker, blackjack or keno, any other bonus triggering events and any other bonus round games. The symbols and indicia used on and in gaming device may be in mechanical, electrical or video form.

As illustrated in FIGS. 1A, 1B and 1C, the gaming devices 10*a*, 10*b* and 10*c* include a coin slot 12 and bill acceptor 14 where the player inserts money, coins or tokens. The player can place coins in the coin slot 12 or paper money in the bill acceptor 14. Other devices could be used for accepting payment such as readers or validators for credit cards or debit cards. When a player inserts money in gaming device, a number of credits corresponding to the amount deposited is shown in a credit display 16. After depositing the appropriate amount of money, a player can begin the game by pulling arm 18 or pushing play button 20. Play button 20 can be any play activator used by the player which starts any game or sequence of events in the gaming device.

As shown in FIGS. 1A, 1B and 10C the gaming devices 10*a*, 10*b* and 10*c* also include a bet display 22 and a bet one button 24. The player places a bet by pushing the bet one button 24. The player can increase the bet by one credit each time the player pushes the bet one button 24. When the player pushes the bet one button 24, the number of credits shown in the credit display 16 decreases by one, and the number of credits shown in the bet display 22 increases by one. The gaming devices may also include a bet max button which enables the player to easily make the maximum allowed wager.

A player may cash out and thereby receive a number of coins corresponding to the number of remaining credits by pushing a cash out button 26. When the player cashes out the player receives the coins in a coin payout tray 28. The gaming device may employ other payout mechanisms such as credit slips redeemable by a cashier or electronically recordable cards which keep track of the player's credits.

Figure 6:
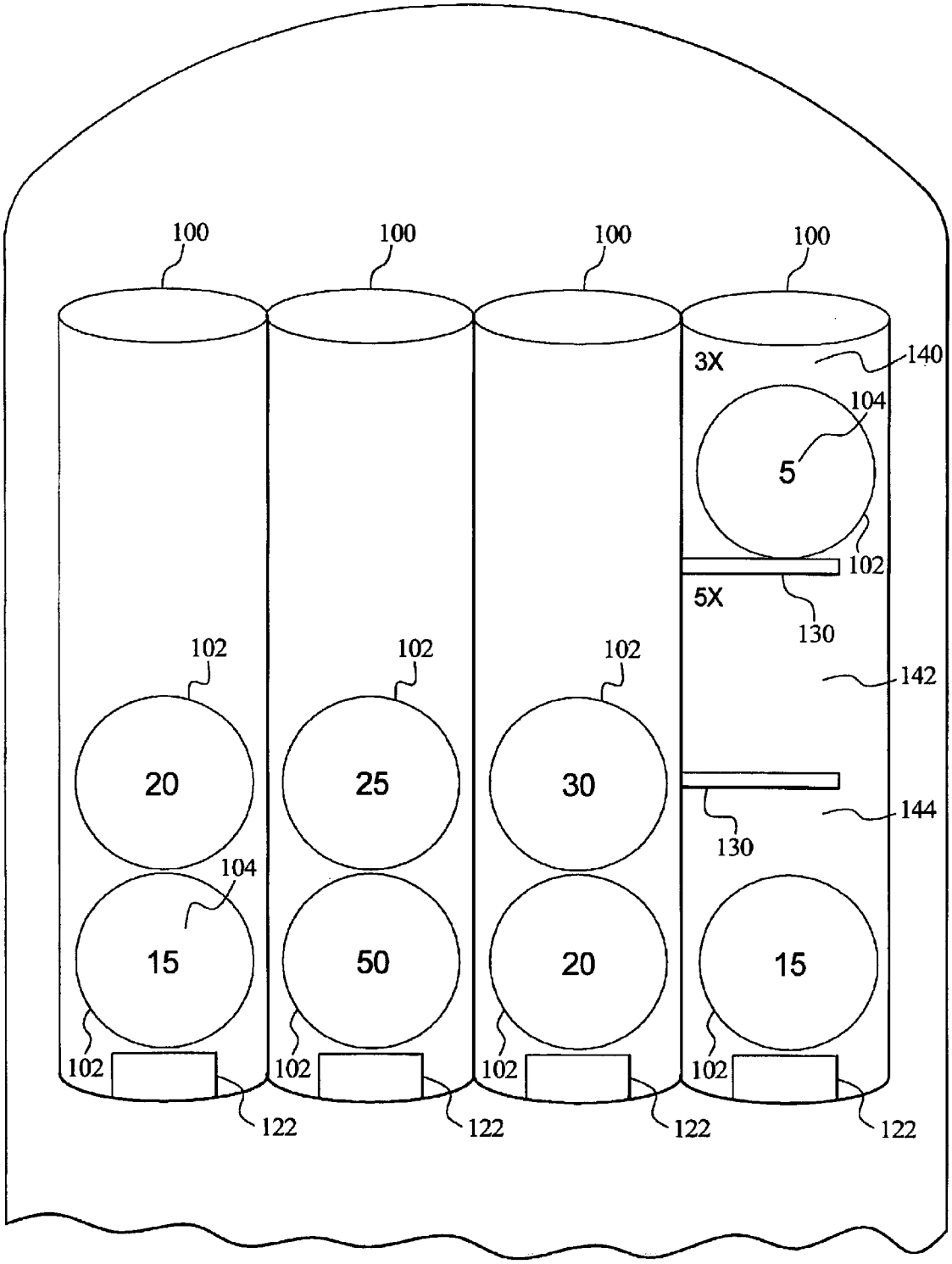
FIG. 6 is a front elevation view of the plurality of vertically aligned tubes that house the movable objects of the present invention illustrating multiple moving objects in each tube.

As shown in FIGS. 1A and 1C, gaming devices 10*a* and 10*c* also include a plurality of vertically aligned directors 200, such tubular members or channels attached to the cabinet of the gaming device. It should be appreciated that the plurality of directors or tubes can be horizontally aligned, as discussed below, or aligned at varying angles. The present invention is discussed and illustrated primarily with four aligned tubes, however it should be appreciated that any number of tubes may be employed in accordance with the present invention. It should be further appreciated that one tube may be employed in accordance with the present invention. Each tube is preferably transparent, allowing the player to view the movement of each movable object. In an alternative embodiment, a portion of each tube is transparent. In another embodiment, at least one tube is transparent and at least one tube is partially transparent. As seen in FIGS. 1A, 1B and 1C, a movable object 102 with an indicated usable symbol 104 is positioned in and rests at the base of each tube. The present invention is discussed herein primarily in relation to multiple moving balls, however it should be appreciated that other suitable objects may be employed in accordance with the present invention. In an alternative embodiment, as seen in FIG. 6, a plurality of movable objects are positioned in and rest at the base of each tube. In this embodiment, each tube may house a different number of movable objects.

Figure 3A:
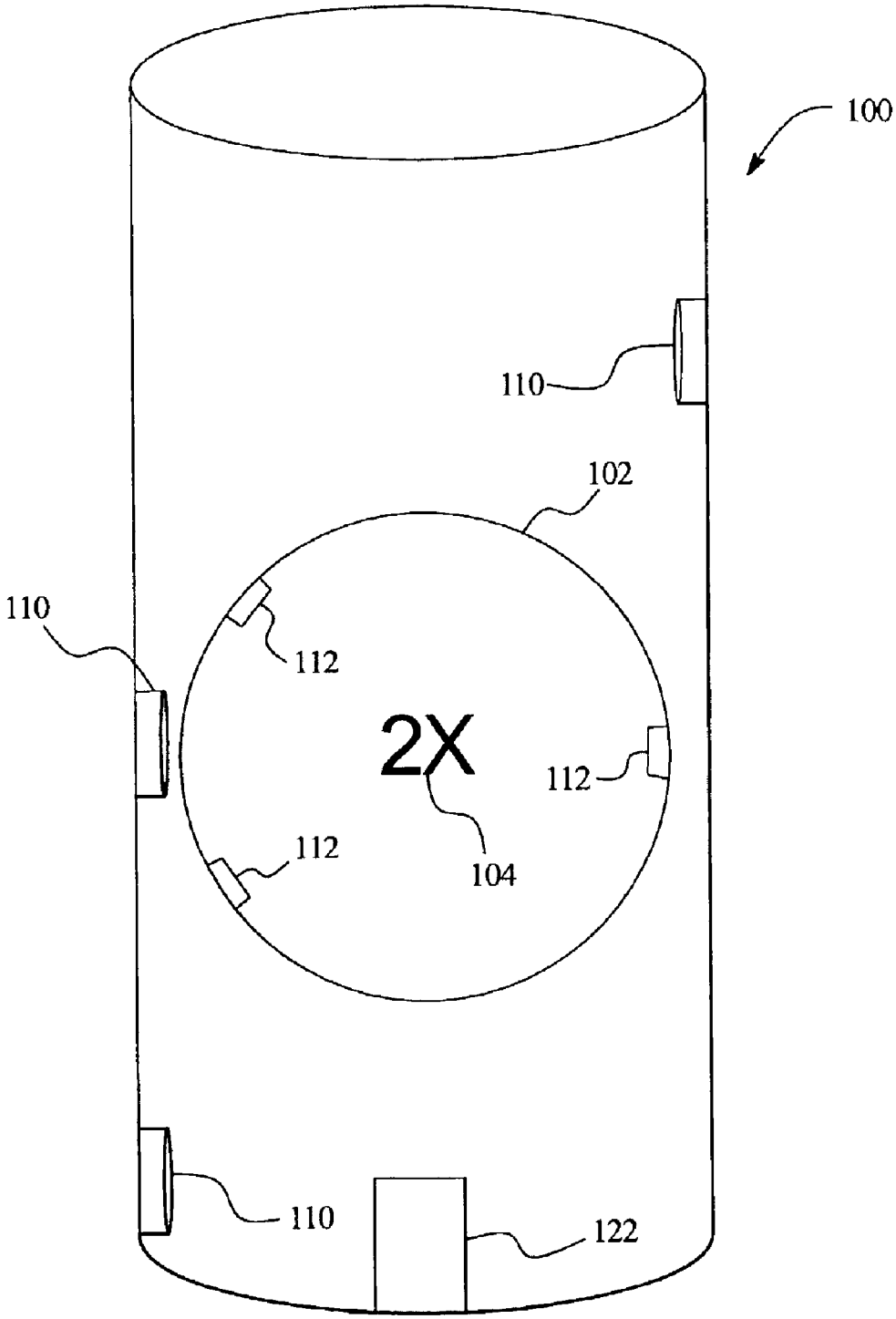
FIGS. 3A and 3B are fragmented views of a tube that houses a movable object in the present invention.
Figure 3B:
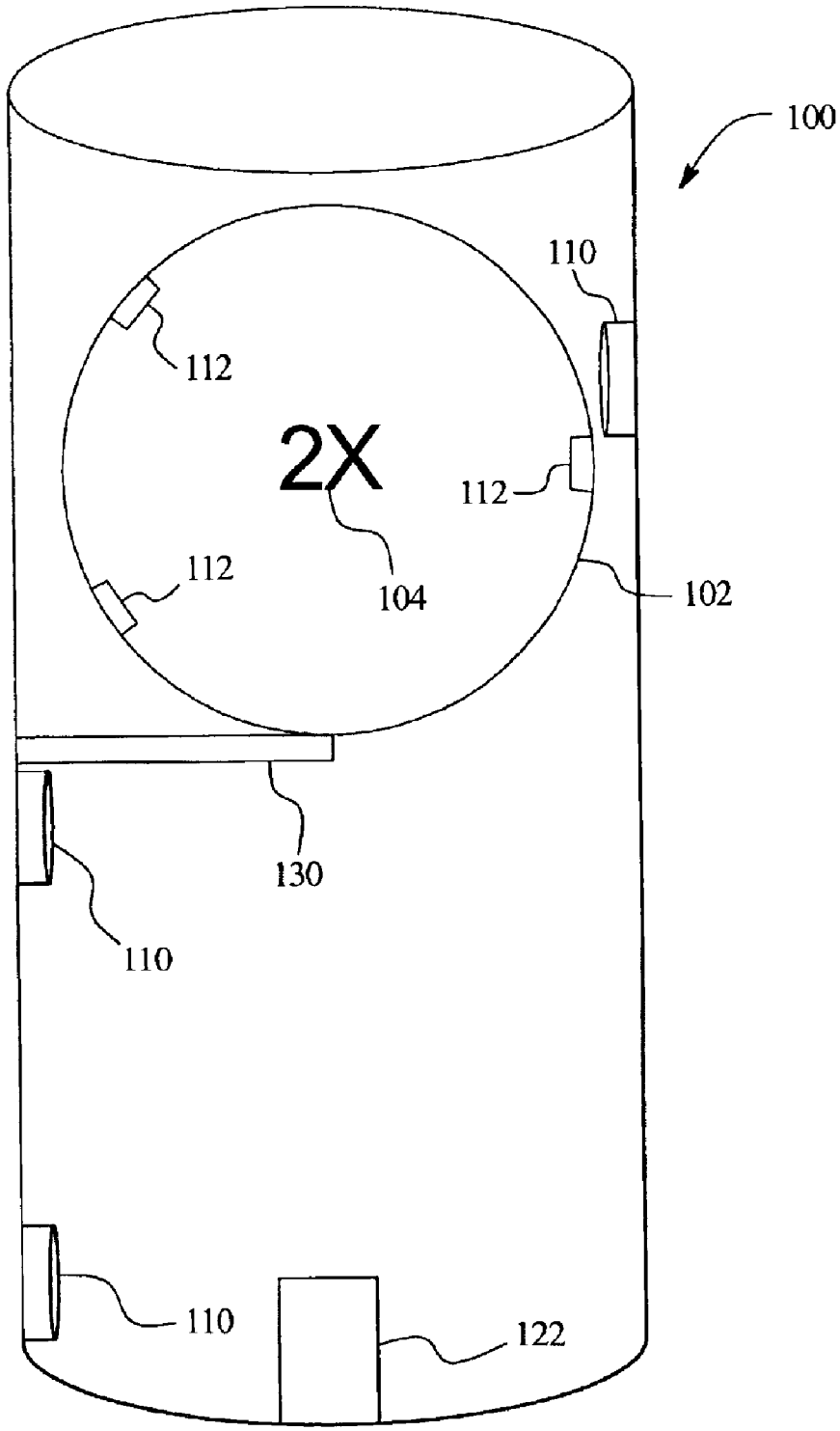

As further illustrated in FIGS. 3A and 3B, an actuator 122, such as a solenoid, spring mechanism, magnetic device, electromagnet, air injector, or other suitable actuating member capable of propelling or directing each movable object into the upper portion of each tube is positioned at the base of each tube 100. In an alternative embodiment, the actuator of each tube is positioned adjacent to the tube and extends upward into the tube. Once activated, the actuator remains active to continuously engage the movable object in the director or tube. As seen in FIG. 3B, a partitioner 130, such as a solenoid, vacuum, motor or other suitable partitioning member capable of partitioning each tube into a plurality of sections and capturing a movable object in the partitioned section is attached to each tube. In an alternative embodiment, a plurality of partitioners are attached to each tube at varying heights.

Each tube further includes a movable object sensor (such as an optical sensor, a magnetic sensor or other suitable means) to enable the processor of the gaming device to determine the location, speed and direction of movement of each movable object. As shown in FIGS. 3A and 3B, attached at varying heights to the inner walls of each tube are a plurality of optical sensors 110 which are connected to the gaming device processor. In one embodiment, the optical sensors 110 are coupled with optical receptors 112 affixed to each movable object. As illustrated in FIGS. 3A and 3B, an optical sensor 110 is attached to the inner wall near the base of each tube 100, thereby allowing the optical sensor 110 to detect when the movable object is at the base of each tube. Additional optical sensors 110 are attached at a plurality of locations along the inner walls or ceiling of each tube. It should be appreciated by utilizing the sensors, the processor avoids extending a partitioner directly into a movable object 102. Any suitable commercially available optical sensor may be used.

Figure 5A:
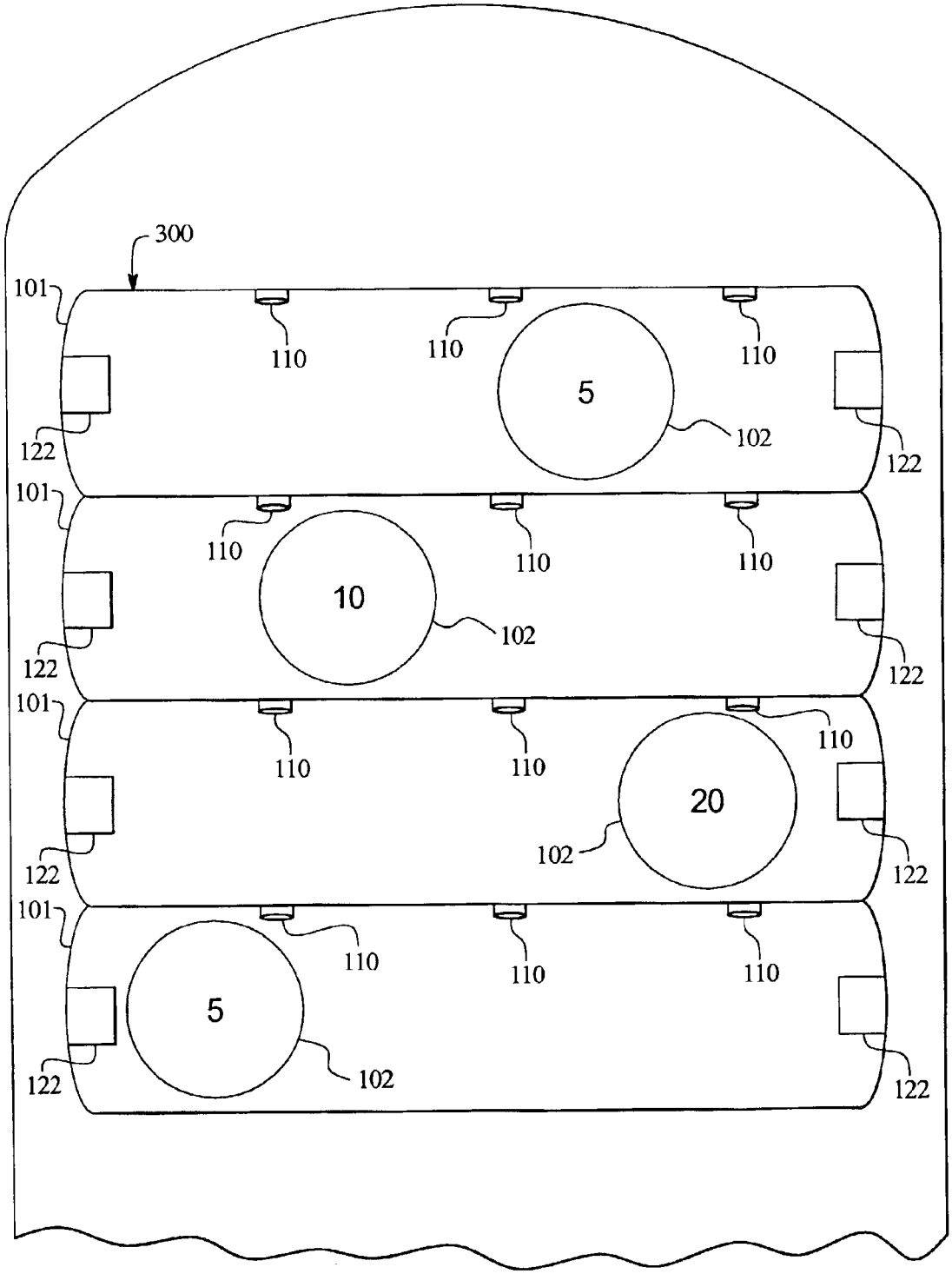
FIGS. 5A and 5B are front elevational views of an alternative embodiment of the gaming device of the present invention illustrating a plurality of horizontally aligned tubes.
Figure 5B:
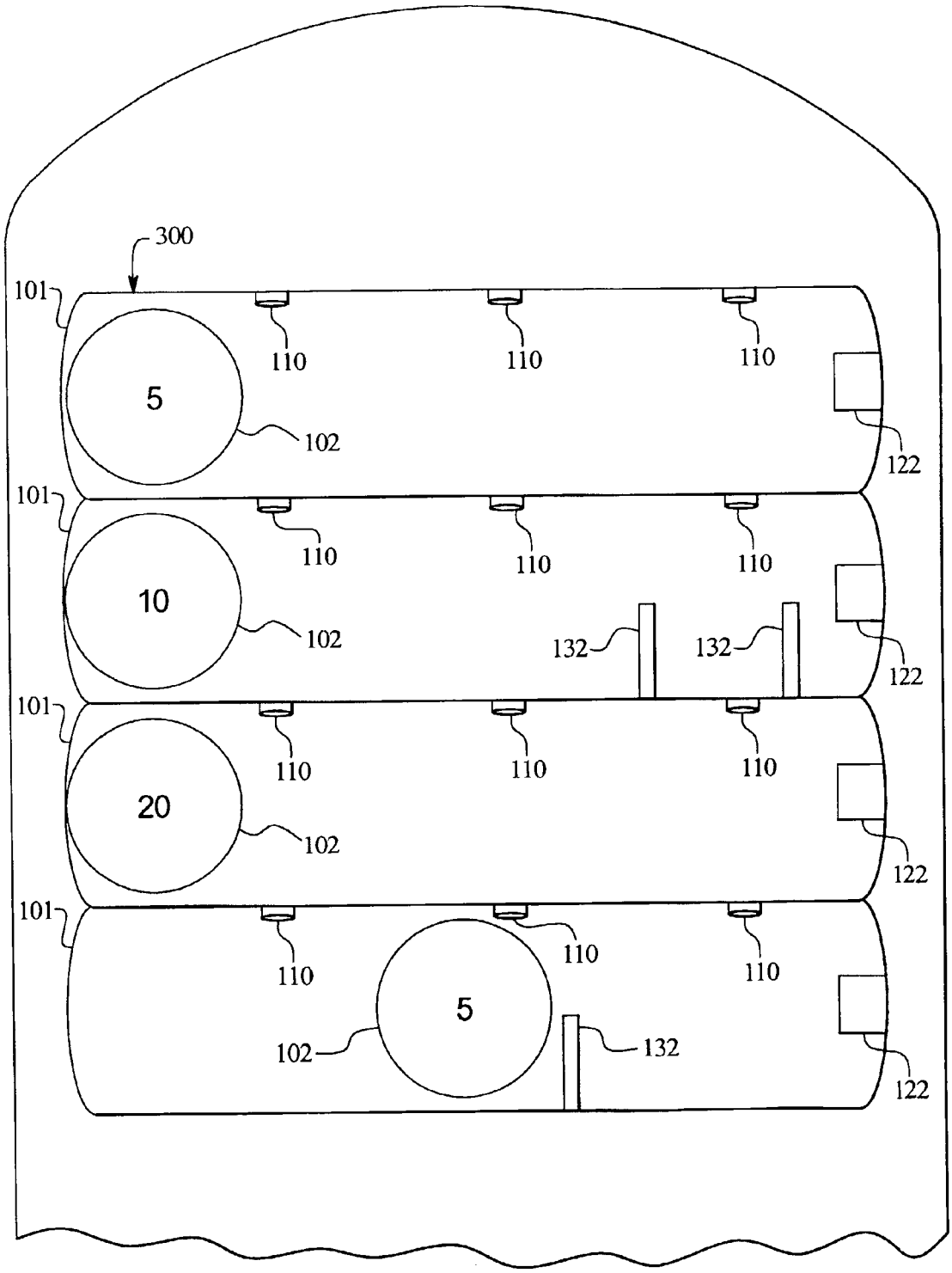

As illustrated in FIGS. 5A through 5B, an alternative embodiment of the present invention includes a plurality of horizontally aligned directors, channels or tubular members 300 attached to the cabinet of the gaming device. In this embodiment, actuators 122 are attached at both ends of each tube 101. When activated, each actuator engages the movable object in its tube, propelling the movable object to the other end of the tube. Each activated actuator remains activated to continuously engage each movable object, thereby propelling each movable object back and forth along the length of the tube. As seen in FIG. 5B, a partitioner 132 is also attached to each tube at varying lengths, enabling each tube to be partitioned into a plurality of sections and capturing a movable object caught in the formed section.

Gaming device 10 also includes one or more display devices. The embodiment shown in FIGS. 1A and 1C includes a central display device 30, and the alternative embodiment shown in FIG. 1B includes a central display device 30 as well as an upper display device 32. Gaming device 10 may display a plurality of reels 34, such as three to five reels 34 in mechanical or video form at one or more of the display devices. However, it should be appreciated that the display devices can display any visual representation or exhibition, including but not limited to movement of physical objects such as mechanical reels and wheels, mechanical tubular members, dynamic lighting and video images. A display device can be any viewing surface such as glass, a video monitor or screen, a liquid crystal display or any other display mechanism. If the reels 34 are in video form, the display device for the video reels 34 is preferably a video monitor. It should be appreciated that although the mentioned embodiments describe a gaming device having mechanical tubes, as in FIG. 1B, the present invention may be electronic or video based. Alternatively, the gaming device could incorporate a plurality of mechanical tubes coupled with a plurality of video based tubes. In an alternative embodiment, by utilizing a predetermined sequence of lighting, the gaming device simulates movable objects being propelled in the tubes.

Each reel 34 displays a plurality of indicia such as bells, hearts, fruits, numbers, letters, bars or other images which preferably correspond to a theme associated with the gaming device. Furthermore, gaming device preferably includes speakers 36 for making sounds or playing music.

Figure 2:
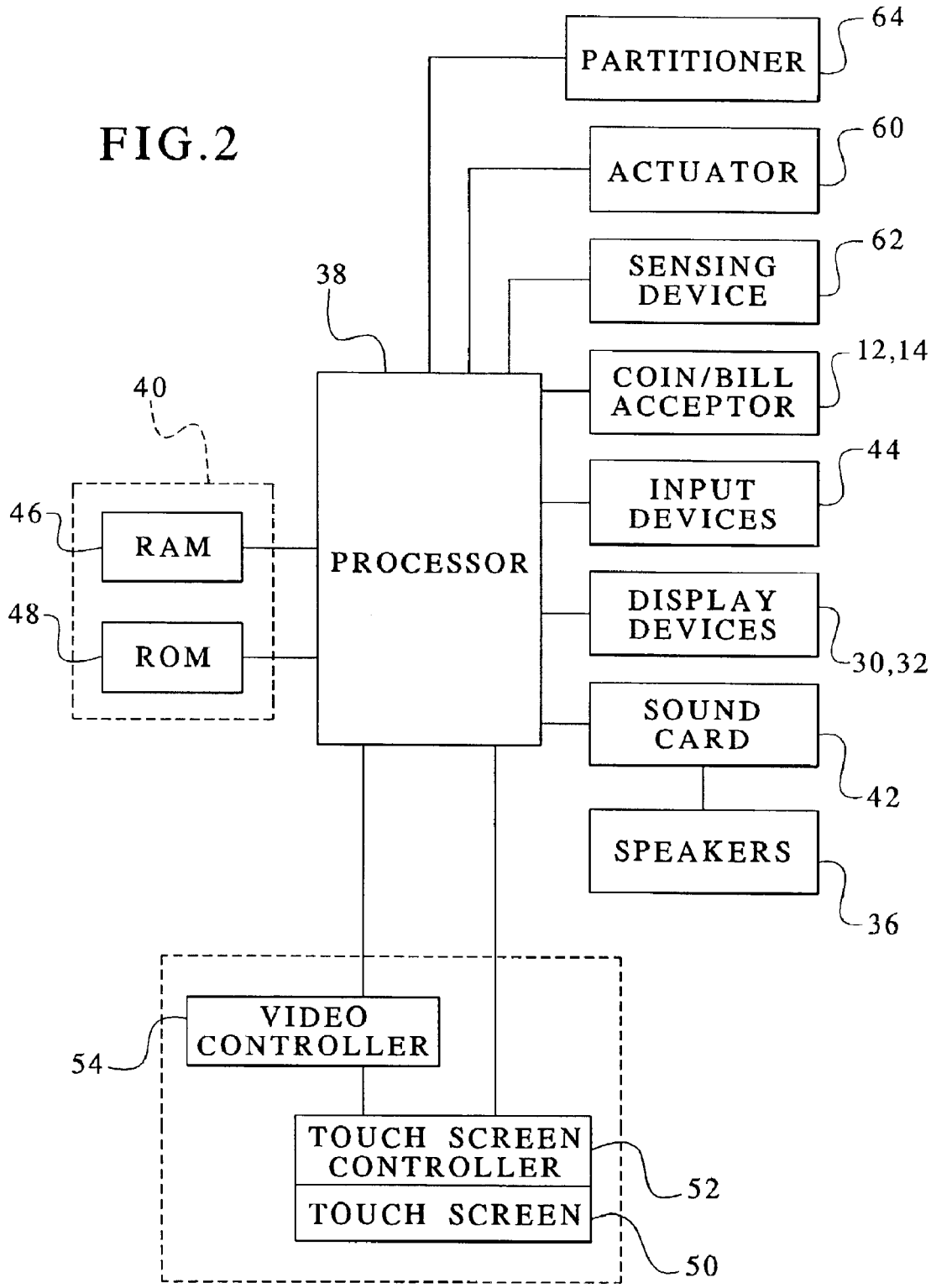
FIG. 2 is a schematic block diagram of the electronic configuration of one embodiment of the gaming device of the present invention.

As illustrated in FIG. 2, the general electronic configuration of gaming device preferably includes: a processor 38; a memory device 40 for storing program code or other data; a central display device 30; an upper display device 32; a sound card 42; a plurality of speakers 36; an actuator 60 for propelling each movable object; a partitioner 64 for partitioning each tube into a plurality of sections; a plurality of sensors 62 for determining the location and direction of movement of each movable object; and one or more input devices 44. The processor 38 is preferably a microprocessor or microcontroller-based platform which is capable of displaying images, symbols and other indicia such as images of people, characters, places, things and faces of cards. The memory device 40 can include random access memory (RAM) 46 for storing event data or other data generated or used during a particular game. The memory device 40 can also include read only memory (ROM) 48 for storing program code which controls the gaming device 10 so that it plays a particular game in accordance with applicable game rules and pay tables.

As illustrated in FIG. 2, the player preferably uses the input devices 44, such as pull arm 18, play button 20, the bet one button 24 and the cash out button 26 to input signals into gaming device 10. In certain instances it is preferable to use a touch screen 50 and an associated touch screen controller 52 instead of a conventional video monitor display device. Touch screen 50 and touch screen controller 52 are connected to a video controller 54 and processor 38. A player can make decisions and input signals into the gaming device 10 by touching touch screen 50 at the appropriate places. As further illustrated in FIG. 2, the processor 38 can be connected to coin slot 12 or bill acceptor 14. The processor 38 can be programmed to require a player to deposit a certain amount of money in order to start the game.

It should be appreciated that although a processor 38 and memory device 40 are preferable implementations of the present invention, the present invention can also be implemented using one or more application-specific integrated circuits (ASIC's) or other hard-wired devices, or using mechanical devices (collectively or alternatively referred to herein as a "processor"). Furthermore, although the processor 38 and memory device 40 preferably reside on each gaming device unit, it is possible to provide some or all of their functions at a central location such as a network server for communication to a playing station such as over a local area network (LAN), wide area network (WAN), Internet connection, microwave link, and the like. The processor 38 and memory device 40 is generally referred to herein as the computer or controller.

With reference to FIGS. 1A, 1B, 1C and 2, to operate the gaming device in one embodiment, the player must insert the appropriate amount of money or tokens at coin slot 12 or bill acceptor 14 and then pull the arm 18 or push the play button 20. The reels 34 will then begin to spin. Eventually, the reels 34 will come to a stop. As long as the player has credits remaining, the player can spin the reels 34 again. Depending upon where the reels 34 stop, the player may or may not win additional credits.

In addition to winning credits in this manner, preferably gaming device also gives players the opportunity to win credits in a bonus round. This type of gaming device will include a program which will automatically begin a bonus round when the player has achieved a qualifying condition in the game. This qualifying condition can be a particular arrangement of indicia on a display device. The gaming device preferably uses a video-based central display device 30 to enable the player to play the bonus round. Preferably, the qualifying condition is a predetermined combination of indicia appearing on a plurality of reels 34. As illustrated in the five reel slot game shown in FIG. 1A, the qualifying condition could be a seven appearing on three adjacent reels 34 along a payline 56. It should be appreciated that the present invention can include one or more paylines displayed in a horizontal and/or diagonal fashion.

Referring now to FIGS. 4A through 4F, one embodiment of the present invention provides a plurality of vertically aligned directors or tubular members adapted to provide a payout. It should be appreciated that in another embodiment of the present invention a single tube is employed in the bonus game. Each tube houses one movable object, such as a ball. A usable symbol such as a credit, a dollar amount, an opportunity for a player to participate in a different bonus game, or a multiplier (or other modifier) is associated with and indicated on each movable object. For increased entertainment, the usable symbol may not be indicated on each movable object. In an alternative embodiment, a usable symbol, such as a modifier, is associated with and indicated on each tube.

In one embodiment of the present invention, during the playing of the primary game, a movable object is positioned in and rests at the base of each tube. Upon the triggering of the bonus game, the processor of the gaming device activates the actuator at the base of at least one tube. In one embodiment, the actuator in at least one tube is not activated during the bonus game. In this embodiment, the number of activated actuators in the tubes may be randomly determined, predetermined or determined in connection with the play of the primary game. For example, the players wager in the primary game determines the number of activated actuators. If the player wagers the minimum amount possible in the primary game, during the bonus game the processor of the gaming device may activate the actuator for one tube. On the other hand, if the player wagers the maximum amount possible in the primary game, during the play of the bonus game, the actuator for each tube may be activated. It should be appreciated that the actuators can be simultaneously activated, sequentially activated or randomly activated. In another alternative embodiment, as shown in FIG. 1C, upon the triggering of the bonus game, the player may activate the actuator 122 located in each tube 100 by using an actuator indicator 182 attached to the cabinet of the gaming device. In another embodiment, the player and gaming device may each activate the actuator of at least one tube.

The activated actuator in each tube engages that tubes movable object causing the movable object to be propelled or directed into the upper portion of the tube. The activated actuators remain activated to continuously engage the movable object of each activated actuators tube. Therefore, each time a movable object returns to the base of it's tube, it is repropelled into the upper portion of the tube. It should be appreciated that the actuator of each tube may continuously engage the movable objects in their tubes at differing time increments during the bonus game. For example, one active actuator may actuate every second while another active actuator may actuate every five seconds.

Each activated actuator remains active in repropelling the movable object throughout the tube until each actuator is deactivated by the gaming device. It should be appreciated that the actuators can be simultaneously deactivated, sequentially deactivated or randomly deactivated by the processor. In another embodiment, as shown in FIG. 1C, the player may deactivate the actuator located in each tube by using the actuator indicator 182 attached to the cabinet of the gaming device. In another embodiment, the player and gaming device may each deactivate the actuator of at least one tube. It should be appreciated that a suitable dampening device may be positioned at the base of each tube, thereby preventing any movable objects from repeatedly bouncing around the base of the tube when the actuators have been deactivated.

Upon the deactivation of each actuator, the partitioner attached to the tube with the deactivated actuator may be activated. The number of activated partitioners may be randomly determined or predetermined. For instance, the partitioner of a tube that houses a movable object with a symbol indicating an award amount of a greater value may be activated less frequently than the partitioner of a tube that houses a movable with a symbol indicating an award amount of a lessor value. Each activated partitioner can be simultaneously activated, sequentially activated or randomly activated. In an alternative embodiment, as shown in FIG. 1C, the player may activate a partitioner located in each tube by utilizing the partitioner indicator 184 attached to the cabinet of the gaming device. In this case, a player's skill, particularly their hand eye coordination becomes a factor in the bonus game. It should be appreciated that to make the game random the gaming device processor may not immediately activate each partitioner after the player utilizes the partitioner indicator.

Each activated partitioners extend horizontally into the center of its tube, partitioning each tube into a plurality of sections, such as an upper and a lower section. In an alternative embodiment, a plurality of partitioners are attached at varying heights to each tube. When activated, each activated partitioner extends into the center of its respective tube, partitioning the tube into at least two sections. The partitioner captures or prevents the moving objects that are located in the upper section of the tube from falling to the lower section and vice versa. The processor of the gaming device utilizes signals received from the sensors positioned at or in each tube to determine what section of the tube each movable object is captured in. If a movable object is captured in a predetermined section of the tube, the player obtains the award indicated on the symbol of the captured movable object. In one embodiment, the player obtains as their award a combination of all awards indicated on the symbols of all the captured movable objects. In another embodiment, a player obtains the award indicated on the symbol of the movable object caught in a predetermined section of a specific tube. For instance, a player will obtain an award only if a movable object is captured in the upper section of the second tube. In the alternative embodiment that includes each tube associated with an award or modifier, the player obtains the award associated with any tube that a movable object is captured in. Alternatively, the player may obtain the award indicated on the symbol of a captured movable object modified by the modifier associated with the tube that the movable object was captured in.

In an alternative embodiment, the actuator and partitioner in at least one tube are simultaneously active. In this embodiment, the activated partitioners continuously oscillate into and out of the center of each tube simultaneously with the activated actuators continuously engaging the movable objects of each tube. In this embodiment, the actuators and partitioners of each tube are deactivated at the same time. The actuators in a plurality of tubes may deactivate before or after the deactivation of the partitioners in each tube. It should be further appreciated that any partitioners that are in an extended position when deactivated, will remain in an extended position thereby allowing the tube to be partitioned into at least two sections. The game proceeds as described above with the player obtaining the award indicated by the symbol on the captured object.

Figure 4A:
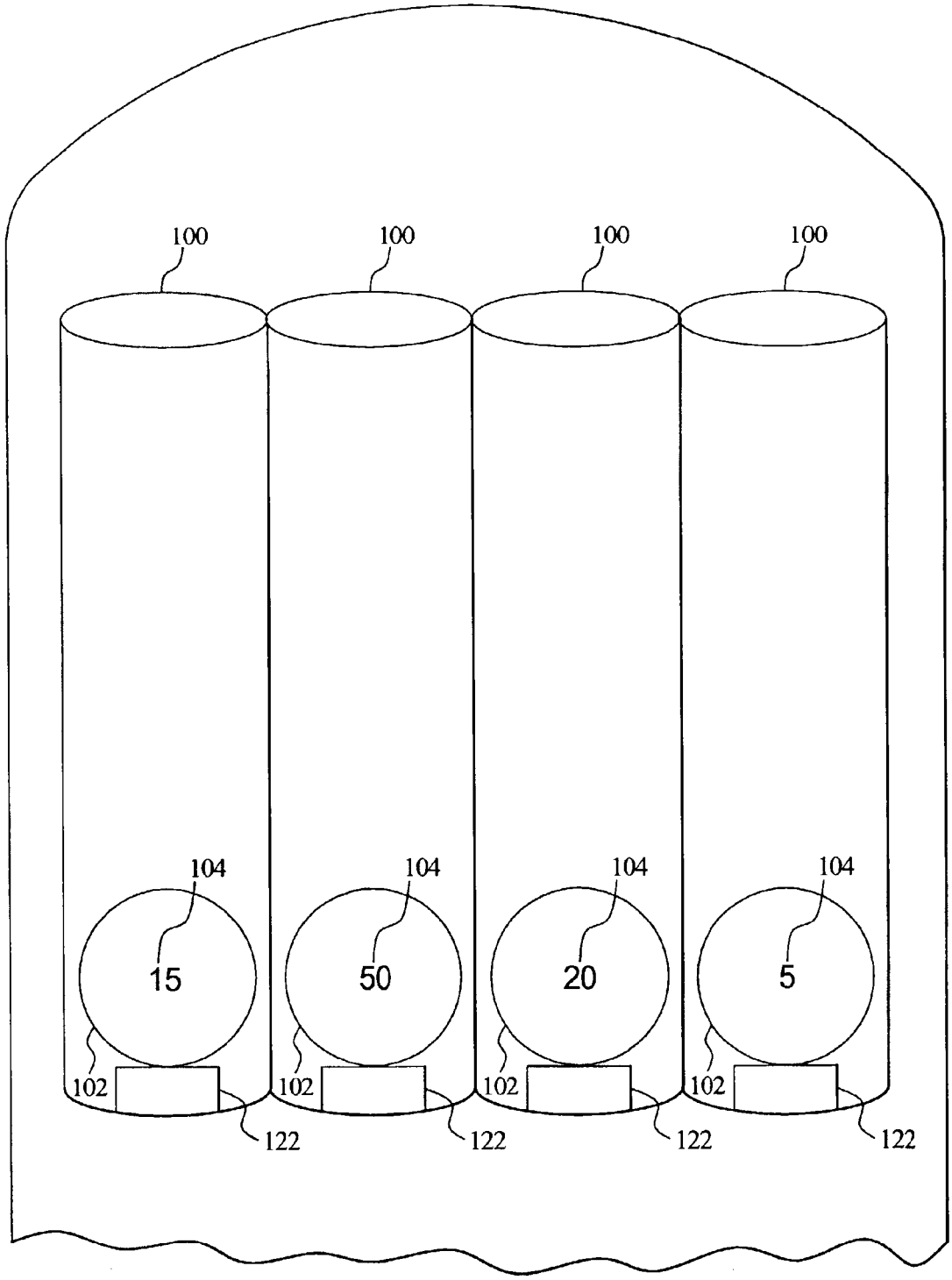
FIGS. 4A through 4F are front elevation views of the plurality of vertically aligned tubes that house the movable objects of the present invention illustrating the movement of the objects and an award being obtained.
Figure 4B:
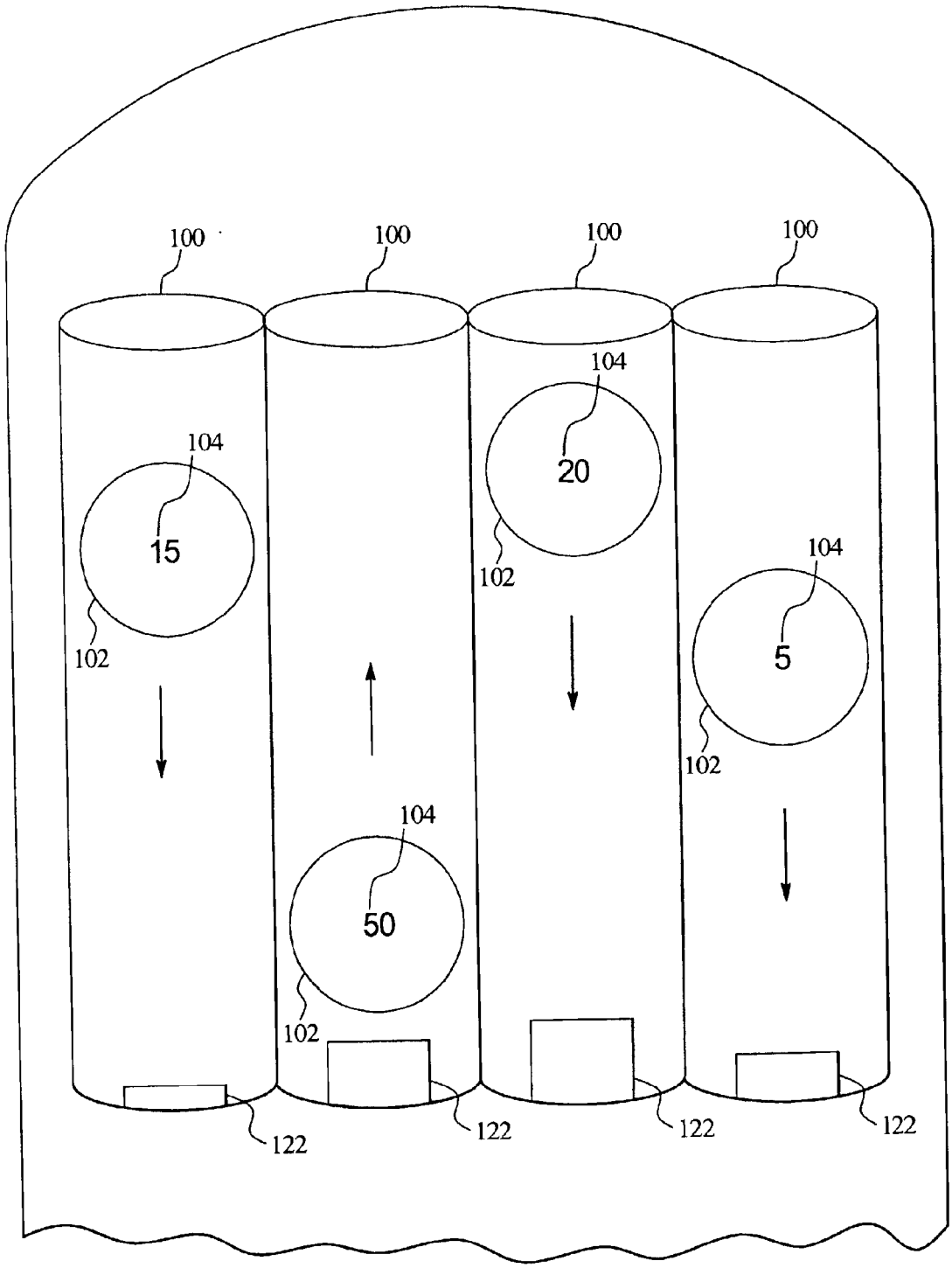

As shown in FIG. 4A, during the playing of the primary game, the movable object 102 is positioned in and rests at the base of each tube 100. A usable symbol 104 is indicated on each movable object. In this case, the award amounts of fifteen, fifty, twenty and five are indicated on the movable objects housed in the first, second, third and fourth tubes, respectively. As seen in FIG. 4B, upon the triggering of the bonus game (see also block 150 in FIG. 7), the actuator 122 in each tube is activated (see also block 152 in FIG. 7). Each activated actuator engages the movable object 102 propelling it into the upper portion of the tube (see also block 154 in FIG. 7). It should be appreciated that, as indicated by the directional arrows, each activated actuator continuously engages each movable object each time the movable object returns to the base of it's tube thereby continuously to be repropelling the movable object into the upper section of the tube (see also block 160, decision diamond 162, and block 152 in FIG. 7).

Figure 4C:
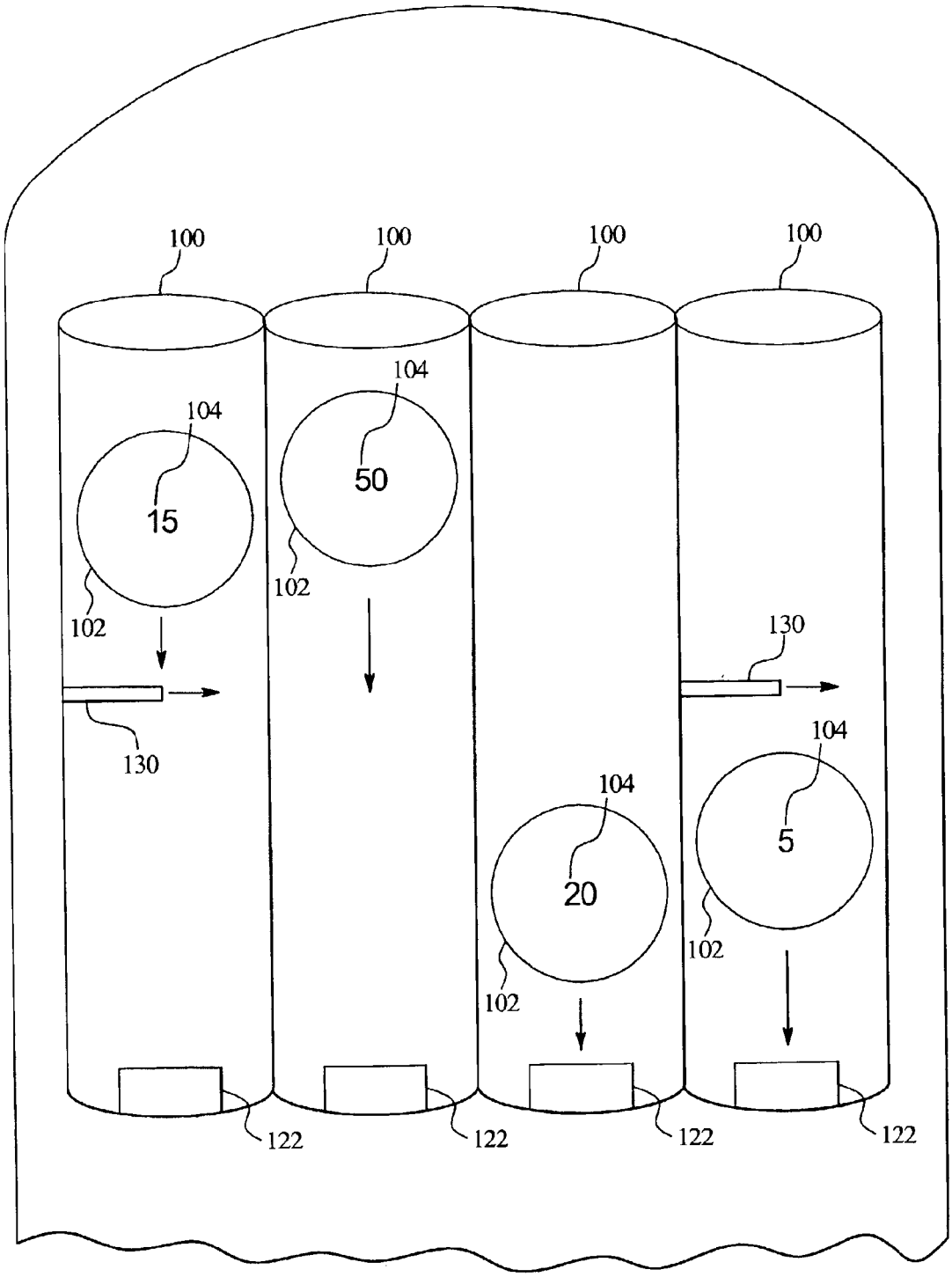
Figure 4D:
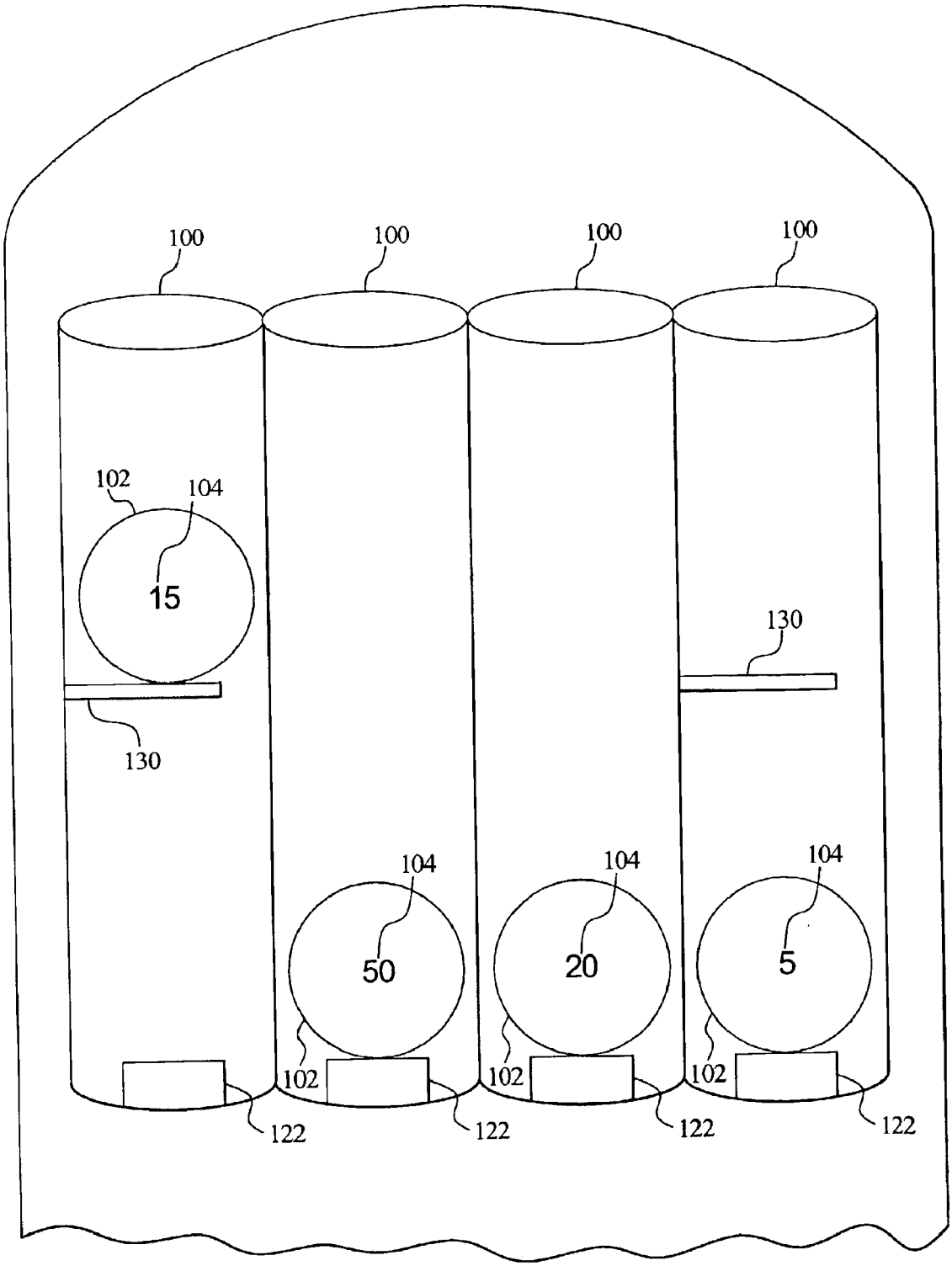
Figure 7:
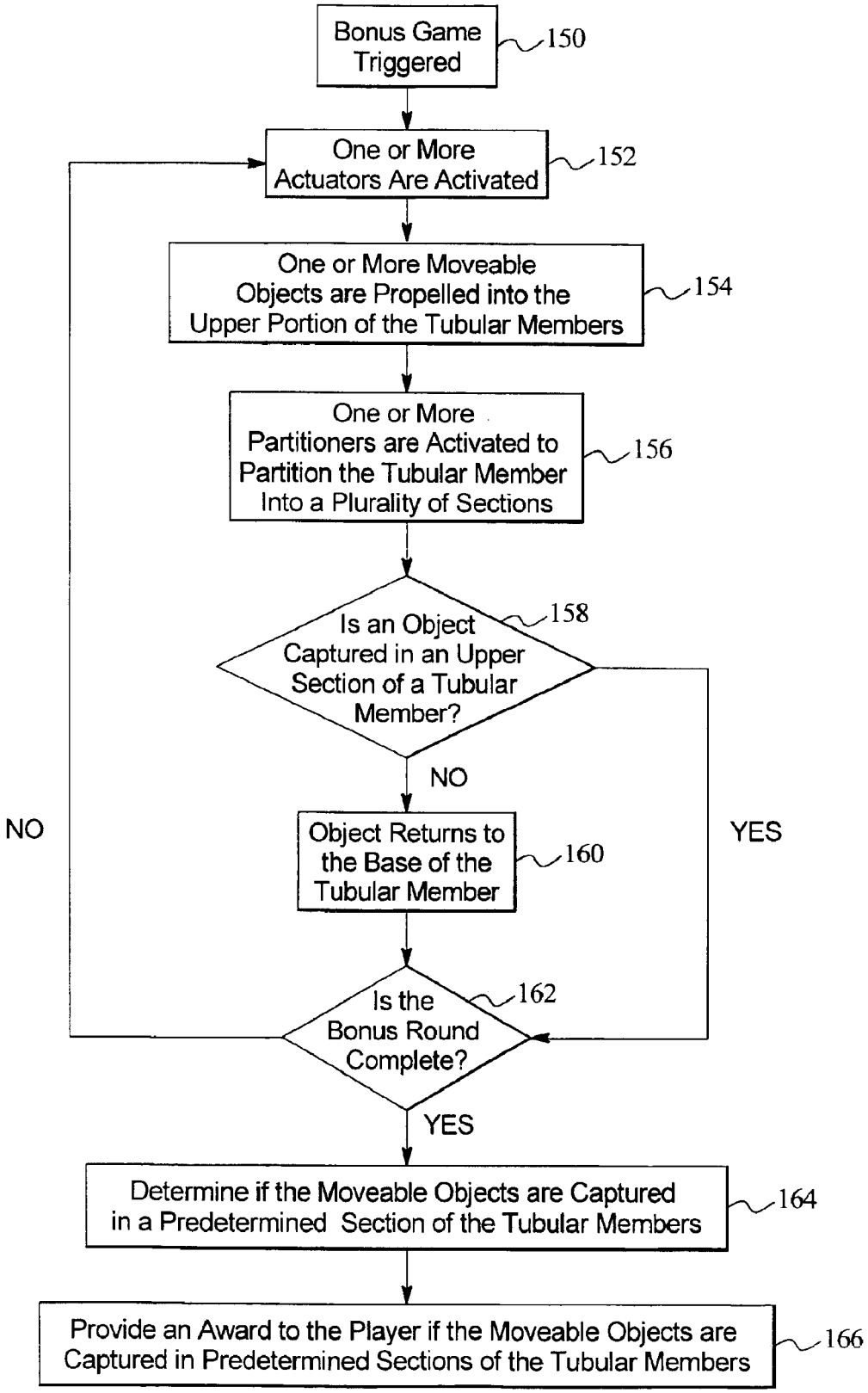
FIG. 7 is a flowchart of one of the embodiments of the present invention where movable objects are captured.

As illustrated in FIG. 4C, once the actuator 122 of each tube is deactivated, the partitioner 130 in at least one tube (in this case, the first and fourth tubes) is activated by the processor of the gaming device (see also block 156 in FIG. 7). The activated partitioners extend into the center of their tube, partitioning each tube into an upper and lower section (see also block 156 in FIG. 7). The movable object within the tubes without active partitioners (in this case, the second and third tubes) will return to the base of their respective tube and the player will not obtain an award from these tubes during this bonus round (see also decision diamond 158 in FIG. 7). As shown in FIG. 4D, the player obtains an award depending on if any movable objects are captured in the upper section of any tube (see also blocks 164 and 166 in FIG. 7). In this case, the movable object indicating an award amount of fifteen was caught in the upper section of the first tube. It should be appreciated that although the partitioner was activated in the fourth tube, since no movable object was captured in the upper section of the fourth tube, no award will be obtained from the fourth tube. The player obtains an award amount of fifteen credits and the bonus game ends. Appropriate messages such as "THE BALL FROM THE FIRST TUBE HAS BEEN CAPTURED" and "YOUR BONUS AWARD IS 15 CREDITS" are preferably provided to the player visually, or through suitable audio or audiovisual displays.

Figure 4E:
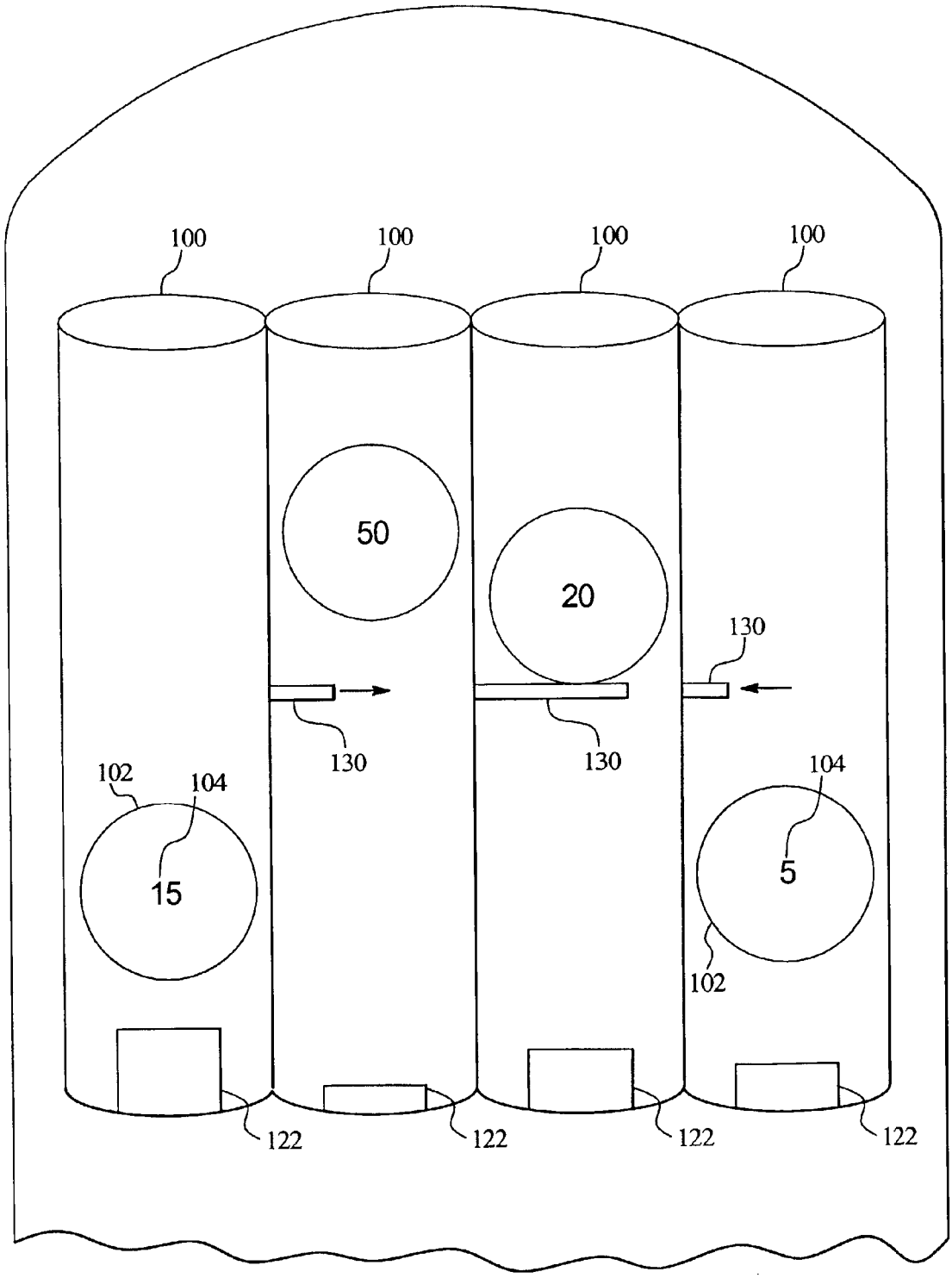

FIG. 4E illustrates the embodiment in which the actuators and partitioners are simultaneously active. The movable objects in each tubes are continuously repropelled throughout their respective tube, while the partitioner in each tube continuously repartitions each tube into a plurality of sections. As seen in FIG. 4E, the movable object indicating an award amount of twenty is temporarily captured in the upper section of the third tube. This embodiment provides increased entertainment to the player because unless the processor deactivates the partitioner immediately (causing the partitioner to remain in its current extended position) the partitioner will contract, the movable object will no longer be captured in the upper section of the third tube and the player will not obtain the award of twenty as indicated on the movable object.

Figure 4F:
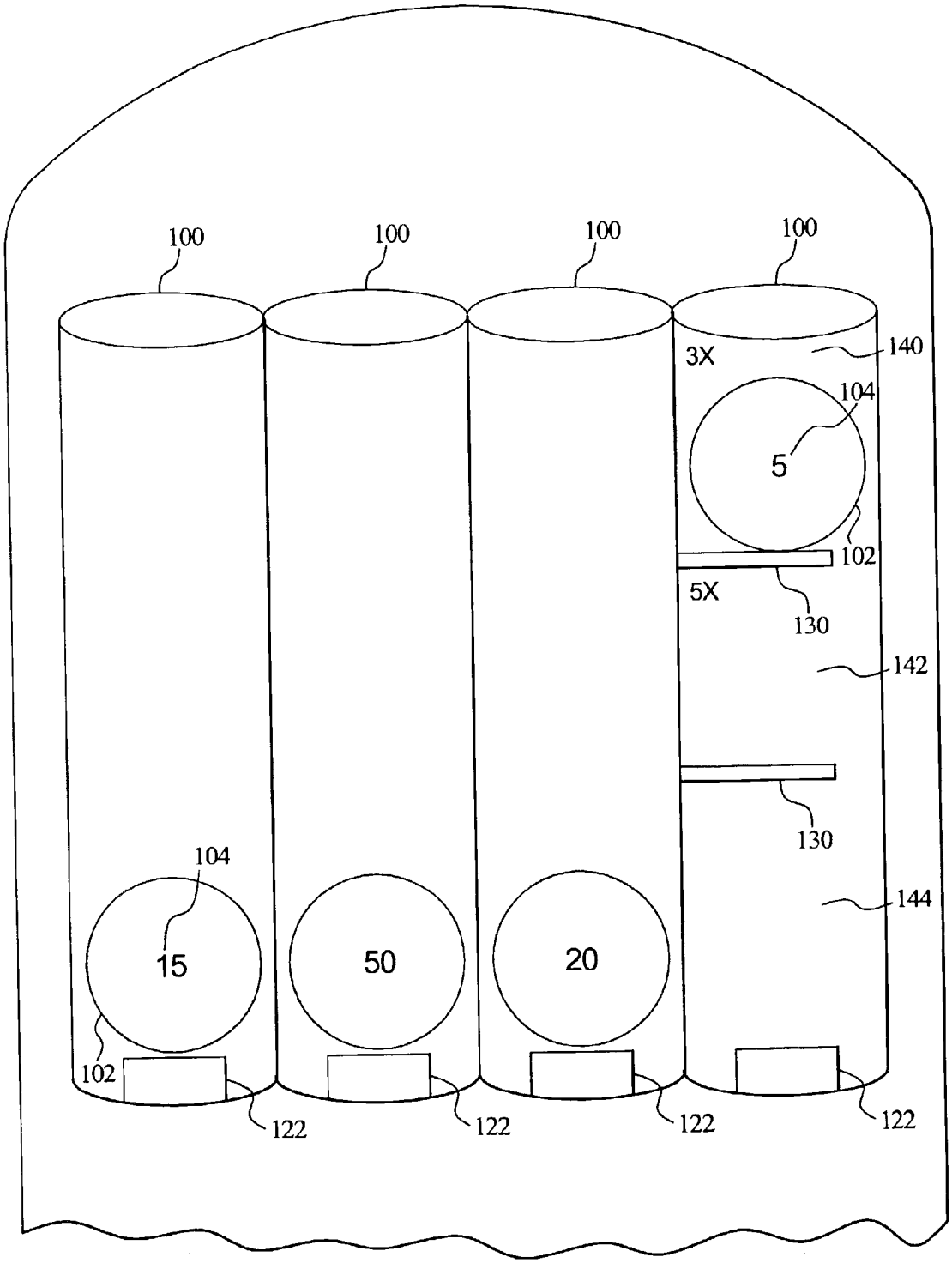

The alternative embodiment with a plurality of partitioners attached at varying heights to each tube is seen in FIG. 4F. In this illustrated embodiment, each partitioned section is associated with a modifier and the player's award is modified according to what section of the tube the movable object is captured in. As illustrated in FIG. 4F, the fourth tube had two activated partitioners, partitioning the tube into an upper section 140, a middle section 142 and a lower section 144. The upper section, middle section and lower section are associated with modifiers of three, five and zero, respectively. As seen in FIG. 4F, the movable object was caught in the upper section. Accordingly, the award indicated by the symbol on the captured object is modified by the modifier associated with the upper section. In this case, the award amount of five indicated by the symbol on the captured object is multiplied by the modifier of three associated with the section the movable object is captured in. The player obtains the award amount fifteen and the bonus game ends.

An alternative embodiment of the present invention, as illustrated in FIGS. 5A and 5B, the gaming device provides a plurality of horizontally aligned tubular members 300 attached to the cabinet of the gaming device. In this embodiment, each horizontal tube 101 has an actuator 122 at both ends of the horizontal tube 101. This double actuator configuration allows for the movable objects 102 to be propelled back and forth from one end of the horizontal tube 101 to the other. Each horizontal tube 101 includes at least one partitioner 132 capable of partitioning each horizontal tube into at least two sections. This embodiment of the bonus game proceeds as described above with the player obtaining an award if a movable object is captured in a predetermined section of a tube.

In one embodiment, an indicator such as a suitable light is associated with each tube or channel to indicate activation of the object in the tube or channel or other game function as described above.

It should be appreciated that the awards provided to the player could be based on the movable objects not captured by the partitioner. It should also be appreciated that the symbols on the moveable objects could function in relation to a primary game or a secondary or an element of a primary game or secondary game.

As indicated above in certain embodiments, the gaming device could enable the player to select one or more channels, one or more actuators, one or more partitioners, or combinations thereof. In certain embodiments, the player's skill may effect the outcome in whole or in part, or the outcome may be completely randomly determined, regardless of whether the player makes any selections or activations.

It should also be appreciated that the player selection of the channels, activators and partitioners can be made one at a time, simultaneously, in groups, or in ranges.

It should also be appreciated that the game of the present invention could be implemented in video or virtual form. In one such embodiment, the presentation could include a suitable light box mechanism, wherein the strobes or other suitable lights are used to simulate movement of the movable object.

In another alternative embodiment (not shown), the player obtains a bonus award depending on how far each movable object is propelled into the upper portion of each tube. In this embodiment, the actuator of each tube is adapted to engage each movable object at varying amounts of force. It should be appreciated that the amount of force produced by each actuator may be randomly determined, or predetermined. For instance, an actuator attached to a tube that houses a movable object associated with a higher bonus award may be programmed to engage the movable object with less force than an actuator attached to a tube that houses a movable object associated with a lower bonus award. It should be appreciated that sensors attached at varying heights along each tube are adapted to determine the location of each movable object. In this embodiment, the player obtains the award associated with the movable object that was propelled the farthest into its respective tube.

While the present invention is described in connection with what is presently considered to be the most practical and preferred embodiments, it should be appreciated that the invention is not limited to the disclosed embodiments, and is intended to cover various modifications and equivalent arrangements included within the spirit and scope of the claims. Modifications and variations in the present invention may be made without departing from the novel aspects of the invention as defined in the claims, and this application is limited only by the scope of the claims.

The invention is claimed as follows:

1. A gaming device comprising:

a primary wagering game operable upon a wager by a player;

a cabinet;

a wager acceptor supported by the cabinet;

a tubular member attached to the cabinet;

a freely movable object positioned in the tubular member;

at least one movable object actuator connected to the tubular member;

at least one moveable partitioner connected to the tubular member, wherein said partitioner is operable to separate the channel into at least two different sections, and prevent the movable object from moving to at least one other section until released;

a movable object sensor positioned relative to the tubular member; and a processor in communication with the wager acceptor, movable object actuator, partitioner, and movable object sensor, said processor operable to provide an award to a player based on a position of the movable object in one of the sections after the sections are partitioned.

2. The gaming device of claim 1, wherein the processor provides an award, if any, to the player after the occurrence of an event in the primary wagering game based on a position of the movable object in the tubular member after the partitioner is activated.

3. The gaming device of claim 1, wherein the processor provides an award, if any, to the player after the occurrence of an event in the primary wagering game based on positions of the movable object in the tubular member after a plurality of activations of the partitioner.

4. The gaming device of claim 1, which includes a plurality of freely movable objects positioned in the tubular member.

5. The gaming device of claim 4, wherein the processor provides an award, if any, to the player after the occurrence of an event in the primary wagering game based on positions of the movable objects in the tubular member after the partitioner is activated.

6. The gaming device of claim 1, wherein a plurality of partitioners are connected to the tubular member.

7. The gaming device of claim 1, which includes an indicator controlled by the processor and associated with the tubular member.

8. A gaming device comprising:

a primary wagering game operable on a wager by a player;

a cabinet;

a wager acceptor supported by the cabinet;

a plurality of aligned tubular members connected to the cabinet;

a freely movable object positioned in each tubular member;

at least one movable object actuator connected to each tubular member;

at least one movable partitioner connected to each tubular member, wherein each of said partitioners is operable to separate at least one channel into at least two different sections and prevent the movable object from moving to at least one other section until released;

a movable object sensor connected to each tubular member; and a processor in communication with the wager acceptor, movable object actuators, partitioners, and movable object sensors, said processor operable to provide an award to a player based on a position of the movable object in one of the sections after the sections are partitioned.

9. The gaming device of claim 8, wherein the processor provides an award, if any, to the player after the occurrence of an event in the primary wagering game based on a position of the movable object in one of the tubular members after the partitioner for said tubular member is activated.

10. The gaming device of claim 8, wherein the processor provides an award, if any, to the player after the occurrence of an event in the primary wagering game based on positions of the movable object in one of the tubular members after a plurality of activations of the partitioner for said tubular member.

11. The gaming device of claim 8, wherein the processor provides an award, if any, to the player after the occurrence of an event in the primary wagering game based on positions of the movable objects in a plurality of the tubular members after the partitioner for said tubular members are activated.

12. The gaming device of claim 8, wherein the processor provides an award, if any, to the player after the occurrence of an event in the primary wagering game based on positions of the movable objects in a plurality of the tubular members after a plurality of activations of the partitioners for said tubular members.

13. The gaming device of claim 8, wherein the processor provides an award, if any, to the player after the occurrence of an event in the primary wagering game based on positions of the movable objects in all of the tubular members after the partitioner for said tubular members are activated.

14. The gaming device of claim 8, which includes a plurality of freely movable objects positioned in at least one of the tubular members.

15. The gaming device of claim 14, wherein the processor provides an award, if any, to the player after the occurrence of an event in the primary wagering game based on positions of said movable objects in said tubular member after the partitioner for said tubular member is activated.

16. The gaming device of claim 8, wherein a plurality of partitioners are connected to at least one of the tubular members, wherein said partitioners are operable to separate said tubular members into a plurality of different sections.

17. The gaming device of claim 8, which includes at least one indicator controlled by the processor and associated with one of the tubular members.

18. The gaming device of claim 8, which includes an indicator associated with each tubular member, said indicators controlled by the processor.

19. The gaming device of claim 8, wherein said tubular members are substantially vertically aligned.

20. The gaming device of claim 8, wherein the actuator associated with each tubular member is positioned at a base of said tubular member.

21. The gaming device of claim 8, which includes a damping device positioned at a base of each tubular member.

22. The gaming device of claim 8, wherein said tubular members are substantially horizontally aligned.

23. The gaming device of claim 22, wherein said actuators are positioned at either end of each tubular member.

24. The gaming device of claim 8, wherein each of said tubular members includes a transparent member.

25. The gaming device of claim 8, wherein a portion of each of said tubular members includes a transparent member.

26. The gaming device of claim 8, wherein at least one tubular member includes a transparent portion and at least one tubular member includes a partially transparent portion.

27. The gaming device of claim 8, wherein said freely movable objects are balls.

28. The gaming device of claim 8, wherein a symbol is indicated on each movable object.

29. The gaming device of claim 8, wherein at least one receptor is affixed to each movable object, wherein each receptor is adapted to be sensed by the movable object sensor associated with the tubular member in which said movable object is positioned.

30. The gaming device of claim 8, wherein said actuators are selected from the group consisting of solenoids, spring mechanisms, magnetic devices, electro-magnet devices and air injectors.

31. The gaming device of claim 8, wherein the actuator in each tubular member is positioned adjacent to said tubular member.

32. The gaming device of claim 8, wherein the actuator in each tubular member is positioned within said tubular member.

33. The gaming device of claim 8, wherein said partitioner for each tubular member is selected from the group consisting of solenoids, spring mechanisms and electro-magnetic devices.

34. The gaming device of claim 8, wherein said movable object sensor for each tubular member is positioned within said tubular member.

35. A gaming device comprising:

a primary wagering game operable upon a wager by a player;

a cabinet;

a plurality of aligned tubular members attached to the cabinet;

a freely movable object positioned in each tubular member;

at least one actuator connected to each tubular member;

at least one movable partitioner connected to each tubular member;

a movable object detection device associated with each tubular member;

a processor which controls said actuators, said partitioners and said movable object detection devices; and an award provided to the player after the occurrence of an event in the primary wagering game after the processor: (a) causes the actuator for at least one of the tubular members to propel the freely movable object in said channel from a resting section of said tubular member into an active section of said tubular member; (b) causes the partitioner to partition said tubular member into a plurality of sections to prevent the movable object from moving to at least one other section until released; and (c) determines if said propelled movable object is captured in a predetermined section of said tubular member, said award based on said determination.

36. The gaming device of claim 35, wherein the award is provided to the player after the processor: (a) causes the actuator for a plurality of the tubular members to propel the movable object in said tubular members from resting sections of said tubular members into active sections of said tubular members; (b) causes the partitioners to partition said tubular members into a plurality of sections to prevent the movable object from moving to at least one other section until released; and (c) determines if said propelled movable objects are captured in predetermined sections of said tubular members, said award based on said determination.

37. A gaming device comprising:

a primary wagering game operable upon a wager by a player;

a cabinet;

a plurality of aligned tubular members connected to the cabinet;

a freely movable object positioned in a lower portion of each tubular member;

at least one actuator for moving said movable object in each tubular member;

at least one movable partitioner for capturing said movable object in each tubular member;

a symbol on each of said movable objects, wherein an award is associated with each symbol; and a processor in communication with said actuators and said partitioners, said processor operable to:

(a) activate said actuators to cause said actuators to engage and propel said movable objects into upper portions of the tubular members, (b) activate said partitioners to partition said tubular members into a plurality of sections, cause said partitioners to capture said propelled movable objects, and prevent said movable objects from moving to at least one other section until released, (c) determine if the movable objects are captured by the partitioners, and (d) provide to the player the award, if any, associated with the symbols on said captured movable objects.

38. The gaming device of claim 37, wherein said processor is operable to continuously actuate each actuator.

39. The gaming device of claim 38, wherein said processor is operable to continuously actuate the actuators in the tubular members at different frequencies.

40. The gaming device of claim 37, wherein said processor is operable to continuously activate the partitioners.

41. The gaming device of claim 40, wherein said processor is operable to continuously activate the partitioners at different frequencies.

42. The gaming device of claim 37, wherein the actuators are player activated.

43. The gaming device of claim 37, wherein the partitioners are player activated.

44. The gaming device of claim 37, wherein the partitioners and actuators are player activated.

45. A method of operating a gaming device including a primary wagering game, said method comprising the steps of:

(a) activating an actuator in a tubular member to propel a freely movable object in said tubular member into a portion of said tubular member;

(b) activating a movable partitioner located in said tubular member to partition said tubular member into a plurality of sections and capture said propelled movable object if said object is located in a predetermined section of said tubular member and prevent the movable object from moving to at least one other section until released;

(c) determining if the object is captured in said predetermined section of said tubular member; and (d) providing an award to a player after the occurrence of an event in the primary wagering game if said movable object is captured in said predetermined section of said tubular member.

46. The method of claim 45, wherein the method is operated through a data network.

47. A The method of claim 46, wherein the data network is an internet.

48. The method of claim 45, wherein computer instructions for steps (a) to (d) are stored on a storage device.

49. A method of operating a gaming device including a primary wagering game, said method comprising the steps of:

(a) activating actuators in a plurality of tubular members to propel freely movable objects in said tubular members into portions of said tubular members;

(b) activating partitioners located in said tubular members to partition said tubular members into a plurality of sections and capture said propelled movable objects if said objects are located in predetermined sections of said tubular members and prevent the movable objects from moving to at least one other section until released;

(c) determining if any of the movable objects are captured in said predetermined sections of said tubular members; and (d) providing an award to a player after the occurrence of an event in the primary wagering game if any of said movable objects are captured in said predetermined sections of said tubular members, said award based on the movable objects captured in said predetermined sections.

50. The method of claim 49, wherein the activated actuators are randomly activated.

51. The method of claim 49, wherein the actuators in said tubular members are sequentially activated.

52. The method of claim 49, wherein the actuators in said tubular members are simultaneously activated.

53. The method of claim 49, wherein at least one actuator is activated by said player.

54. The method of claim 49, wherein the number of activated actuators are determined in the primary wagering game of the gaming device.

55. The method of claim 49, wherein said partitioners are activated when said actuators are deactivated.

56. The method of claim 49, wherein the partitioners are randomly activated.

57. The method of claim 49, wherein the partitioners in said tubular members are sequentially activated.

58. The method of claim 49, wherein the partitioners in said tubular members are simultaneously activated.

59. The method of claim 49, wherein at least one partitioner is activated by said player.

60. The method of claim 49, wherein the number of activated partitioners are determined in the primary wagering game of the gaming device.

61. The method of claim 49, wherein the method is operated through a data network.

62. The method of claim 61, wherein the data network is an internet.

63. The method of claim 49, wherein computer instructions for steps (a) to (d) are stored on a storage device.

64. A method of operating a gaming device including a primary wagering game, said method comprising the steps of:

(a) enabling a player to select at least one of a plurality of tubular members in which an activator associated with said selected tubular member will propel a freely movable object in said tubular member into portions of said tubular member;

(b) activating a partitioner located in said selected tubular member to partition said selected tubular member into a plurality of sections and capture said propelled movable object if said object is located in predetermined section of said selected tubular member and prevent the movable object from moving to at least one other section until released;

(c) determining if the object is captured in said predetermined section of said selected tubular member; and (d) providing an award to a player after the occurrence of an event in the primary wagering game if said movable object is captured in said predetermined section of said selected tubular member.

65. The method of claim 64, wherein the method is operated through a data network.

66. The method of claim 65, wherein the data network is an internet.

67. The method of claim 64, wherein computer instructions for steps (a) to (d) are stored on a storage device.

68. A method of operating a gaming device including a primary wagering game, said method comprising the steps of:

(a) activating an actuator in a channel to propel a freely movable object in said tubular member into a portion of said tubular member;

(b) enabling a player to activate a moveable partitioner located in said tubular member to partition said tubular member into a plurality of sections and capture said propelled movable object if said object is located in a predetermined section of said tubular member and prevent the movable object from moving to at least one other section until released;

(c) determining if the object is captured in said predetermined section of said tubular member; and (d) providing an award to the player after the occurrence of an event in the primary wagering game if said movable object is captured in said predetermined section of said tubular member.

69. The method of claim 68, wherein the method is operated through a data network.

70. The method of claim 69, wherein the data network is an internet.

71. The method of claim 68, wherein computer instructions for steps (a) to (d) are stored on a storage device.

* * * * *

UNITED STATES PATENT AND TRADEMARK OFFICE

CERTIFICATE OF CORRECTION

PATENT NO. : 6,939,225 B2
DATED : September 6, 2005
INVENTOR(S) : Kaminkow

It is certified that error appears in the above-identified patent and that said Letters Patent is hereby corrected as shown below:

Column 7,
Line 31, change “tubes” to -- tubes’ --.

Signed and Sealed this

Thirteenth Day of December, 2005

JON W. DUDAS
*Director of the United States Patent and Trademark Office*